US009287673B2

(12) United States Patent
Galla et al.

(10) Patent No.: US 9,287,673 B2
(45) Date of Patent: Mar. 15, 2016

(54) INSULATION PIERCING CONNECTORS AND METHODS AND CONNECTIONS INCLUDING SAME

(71) Applicants: Tyco Electronics Corporation, Berwyn, PA (US); Tyco Electronics Brasil LTDA, Sao Paulo (BR); Tyco Electronics Simel SAS, Gevrey Chamberlin (FR)

(72) Inventors: Matthew Galla, Holly Springs, NC (US); Jose Alexandre La Salvia, Sao Paulo (BR); Vagner Fuzetti, Branganca Paulista (BR); Kathryn Marie Maher, Cary, NC (US); Sebastien Marcaillou, Argenteuil (FR); Raphael Buthiot, Longecourt-en-Plaine (FR); Luis Otavio Mollica Borelli, Braganca Paulista (BR)

(73) Assignees: Tyco Electronics Corporation, Berwyn, PA (US); Tyco Electronics Brasil LTDA, Sao Paolo (BR); Tyco Electronics Simel SAS, Gevrey Chamberlin (FR)

( * ) Notice: Subject to any disclaimer, the term of this patent is extended or adjusted under 35 U.S.C. 154(b) by 272 days.

(21) Appl. No.: 14/099,309

(22) Filed: Dec. 6, 2013

(65) Prior Publication Data

US 2015/0162670 A1 Jun. 11, 2015

(51) Int. Cl.
*H01R 4/24* (2006.01)
*H01R 43/01* (2006.01)
(Continued)

(52) U.S. Cl.
CPC ..... *H01R 43/01* (2013.01); *H01R 4/2433* (2013.01); *H01R 4/42* (2013.01); *H01R 9/031* (2013.01); *Y10T 29/49201* (2015.01)

(58) Field of Classification Search
CPC ..... H01R 43/01; H01R 9/031; H01R 4/42; H01R 4/2433; H01R 4/2408; H01R 23/667; Y10T 29/49201
USPC ..... 439/403
See application file for complete search history.

(56) References Cited

U.S. PATENT DOCUMENTS 2,164,381 A 7/1939 Bradley
2,219,846 A 10/1940 Meyer
(Continued)

FOREIGN PATENT DOCUMENTS

CN 201111309 Y 9/2008
CN 101308959 A 11/2008
(Continued)

OTHER PUBLICATIONS

Invitation to Pay Additional Fees Corresponding to International Application No. PCT/EP2014/076692; Date of Mailing: Feb. 24, 2015; 7 pages.
(Continued)

*Primary Examiner* — Jean F Duverne
(74) *Attorney, Agent, or Firm* — Myers Bigel & Sibley, P.A.

(57) ABSTRACT

An electrical connector for mechanically and electrically connecting first and second cables, each including an elongate electrical conductor covered by an insulation layer, includes a connector body, an electrically conductive first insulation piercing feature on the connector body, an electrically conductive second insulation piercing feature on the connector body and electrically connected to the first insulation piercing feature, and a compression mechanism. The first insulation piercing feature is configured to pierce through the first insulation layer and electrically engage the first electrical conductor. The second insulation piercing feature is configured to pierce through the second insulation layer and electrically engage the second electrical conductor. The compression mechanism is configured and operable to apply a clamping load along a clamping axis extending through both of the first and second electrical conductors to force the first and second insulation piercing features into electrical engagement with the first and second electrical conductors, respectively.

26 Claims, 31 Drawing Sheets

(51) Int. Cl.
*H01R 4/42* (2006.01)
*H01R 9/03* (2006.01)

(56) References Cited

U.S. PATENT DOCUMENTS

| | | | | |
|---|---|---|---|---|
| 2,858,522 | A | 10/1958 | Wengen et al. | |
| 2,953,771 | A | 9/1960 | Kussy | |
| 3,094,366 | A | 6/1963 | Harmon, Jr. | |
| 3,325,776 | A | 6/1967 | Eppler | |
| 3,372,361 | A | 3/1968 | Wengen | |
| 3,425,028 | A | 1/1969 | Neaderland | |
| 3,688,247 | A | 8/1972 | Prodel | |
| 3,848,956 | A | 11/1974 | Kraft | |
| 3,876,279 | A | 4/1975 | Underwood | |
| 4,070,082 | A | 1/1978 | Werner | |
| 4,247,159 | A | 1/1981 | Fruchard | |
| 4,399,592 | A | 8/1983 | Chopp, Jr. et al. | |
| 4,427,253 | A | 1/1984 | Smith et al. | |
| 5,015,198 | A | 5/1991 | Delin | |
| 5,174,782 | A * | 12/1992 | Bogiel | H01R 23/667 439/404 |
| 5,429,530 | A | 7/1995 | Zander et al. | |
| 5,498,172 | A | 3/1996 | Noda | |
| 5,722,850 | A | 3/1998 | White | |
| 5,842,893 | A | 12/1998 | De Keyser | |
| 5,911,604 | A | 6/1999 | Chadbourne | |
| 5,916,001 | A | 6/1999 | Chadbourne | |
| 5,944,564 | A | 8/1999 | Chadbourne et al. | |
| 5,944,565 | A | 8/1999 | Chadbourne et al. | |
| 6,045,414 | A | 4/2000 | DeFrance | |
| 6,099,344 | A | 8/2000 | Chadbourne | |
| 6,106,323 | A | 8/2000 | Elisei et al. | |
| 6,120,334 | A | 9/2000 | Timsit et al. | |
| 6,135,804 | A | 10/2000 | Lux | |
| 6,152,786 | A | 11/2000 | Perrin et al. | |
| 6,309,261 | B1 | 10/2001 | Chadbourne | |
| 6,322,402 | B1 | 11/2001 | Chadbourne et al. | |
| 6,517,391 | B1 | 2/2003 | Chadbourne | |
| 6,648,671 | B2 | 11/2003 | Suzuki et al. | |
| 6,668,427 | B2 | 12/2003 | Bulanda et al. | |
| 6,692,292 | B2 | 2/2004 | Huiskamp et al. | |
| 6,780,044 | B1 | 8/2004 | Sawyer et al. | |
| 7,104,832 | B2 | 9/2006 | Campbell et al. | |
| 7,695,306 | B2 * | 4/2010 | Chiba | H01C 1/01 39/404 |
| 7,993,169 | B1 | 8/2011 | Hoxha | |
| 8,016,622 | B2 * | 9/2011 | Battle | H01R 4/2408 439/279 |
| 8,444,431 | B1 | 5/2013 | La Salvia | |
| 2013/0130538 | A1 | 5/2013 | La Salvia | |

FOREIGN PATENT DOCUMENTS

| | | | |
|---|---|---|---|
| EP | 1 139 496 | A2 | 10/2001 |
| EP | 1885025 | A2 | 2/2008 |
| EP | 2 360 790 | | 8/2011 |
| FR | 2414800 | A1 | 8/1979 |
| FR | 2901415 | A1 | 11/2007 |
| GB | 1 260 902 | | 1/1972 |
| GB | 2034538 | | 6/1980 |
| JP | H0718357 | U | 3/1995 |

OTHER PUBLICATIONS

Raychem RPG "Stainless Steel Ball Lock Ties" Oct. 22, 2013 (2 pgs); http://www.raychemrpg.com/index.php?option=com_content@view=article&id-193&itemid=293.

Tyco Electronics Simel S.A.S.—TE Energy "Introducing LV Smart Ring Connector" SIM223 Energy PDF; Sep. 2012 (2 pages).

Tyco Electronics "Matèriels de Raccordement et d'isolation our rèseaux" Catalogue general; Sommaire; Edition 07/04; Nov. 2007—rev. 1 (3 pages).

Tyco Electronics; "TE Connectivity Product KZ EP" Oct. 21, 2014 (1 page).

Tyco Electronics; "TE Connectivity Product LV Smart Ring Connector" Oct. 21, 2014 (1 page).

"4 POS Block Ass'y" Tyco Electronics Brasil LTDA, Released Date: Apr. 28, 2009 (1 page).

"6 POS Block Ass'y" Tyco Electronics Brasil LTDA, Released Date: May 5, 2009 (1 page).

"8 POS Block Ass'y" Tyco Electronics Brasil LTDA, Released Date: May 11, 2009 (1 page).

"CDP Conector Derivacao Perfurante Insulated Piercing Connector" Intelli-Industria de Terminais Eletricos LTDA, set/2010 (2 pages).

"Electric Cable Fittings, Insulation Piercing Connector (IPC Connector)" Zhejiang Tianhong Electric Power Fitting Co. Ltd., Retrieved Date: Nov. 21, 2011, From URL: http://www.powerfittings.com/1-1-insulation-piercing.html (1 page).

"Ilsco Insulation Piercing Connectors" Munro Electrical Supplies, Retrieved Date: Nov. 21, 2011, From URL: http://www.munroelectric.com/catalog/ilsco/insulation.html (1 page).

"Insulation piercing connector for customer service information" Tyco Electronics SIMEL S.A.S.—Energy Division, Ref: SIM 006—Mar. 2002 (2 pages).

"Insulation Piercing Connectors for insulated overhead lines" Tyco Electronics SIMEL S.A.S.—Energy Division, Ref: SIM127—Mar. 2003 (2 pages).

"Insulation piercing connector for main to main connection" Tyco Electronics SIMEL S.A.S.—Energy Division, Ref: SIM 007—Mar. 2002 (2 pages).

"Insulation Piercing Connectors for street lighting applications" Tyco Electronics SIMEL S.A.S.—Energy Division, Ref: SIM005-Revised—Jul. 26, 2004 (1 page).

"Insulation Piercing Connectors—IPC" Galvin Industries, Inc., Retrieved Date: Nov. 21, 2011, From URL: http://www.galvanelectrical.com/catalog/insulationPiercingConnectors.asp, 1 page.

"IPC Insulated Piercing Connector" Yueqing Zhicheng Electrical Equipment Co., Ltd., Retrieved Date: Nov. 21, 2011, From URL: http://ceexinyu.en.made-in-china.com/product/YMinZCQvfLVh/China-IPC-Insulated-Piercing-Connector.html (1 page).

"IPC—Insulation Piercing Connectors for Aerial Bundle Cable" EC21 Global B2B Marketplace, Retrieved Date: Nov. 21, 2011, From URL: http://www.ec21.com/product-details/IPC-Insulation-Piercing-Connectors-for--4875553.html (3 pages).

"IPC with 4 POS Block" Tyco Electronics Brasil LTDA, Released Date: Apr. 29, 2009(1 page).

"IPC with 6 POS Block" Tyco Electronics Brasil LTDA, Released Date: May 7, 2009 (1 page).

"IPC with 8 POS Block" Tyco Electronics Brasil LTDA, Released Date: May 7, 2009 (1 page).

"Low Voltage Insulated Overhead Lines (LV ABC)" Tyco Electronics Simel S.A. Energy Division, Mod 03/01—PN: 1242421 / Code: 021444 (12 pages).

"New Improved Product MSC Series Multiple Service Conductor" Sicame Australia Ply Ltd., Installation Instruction No. 15, Issue No. 6, Date of Issue: Sep. 5, 2008 (3 pages).

"Service Insulation Piercing Connectors for Insulated Overhead Lines: P2X95 Mk2" Tyco Electronics SIMEL S.A.S.—Energy Division, Ref: SIM200—Apr. 20, 2009 (1 page).

Notification of Transmittal of the International Search Report and Written Opinion of the International Searching Authority, or the Declaration in corresponding PCT Application No. PCT/BR2012/000440, mailed Jan. 30, 2013 (14 pages).

"Conector Perfurante NFC 33 020" Incesa, 2 pages, Date unknown but prior to Dec. 5, 2012.

"DCNL—Insulated Piercing Connectors" Cavanna Group, 2 pages, Date unknown but prior to Dec. 5, 2012.

"KZ y JZ Conectores Perforantes de Aislamiento IPC" Tyco Electronics Energy Division, Tyco Electronics Brasil S.A., 2 pages, Date unknown but prior to Dec. 5, 2012.

Sicame Group, South Africa, Grounding Connector for All Electrical Grounding, 4 pages, Date unknown but prior to Dec. 5, 2012.

* cited by examiner

INSULATION PIERCING CONNECTORS AND METHODS AND CONNECTIONS INCLUDING SAME

FIELD OF THE INVENTION

The present invention relates to electrical connectors and, more particularly, to power utility electrical insulation piercing connectors and methods and connections including the same.

BACKGROUND OF THE INVENTION

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high, medium or low voltage cables that are relatively large in diameter, and the main power line conductor may be differently sized from the tap conductor, requiring specially designed connector components to adequately connect tap conductors to main power line conductors.

Insulation piercing (IP) connectors are commonly used to form mechanical and electrical connections between insulated cables. Typically, an IP connector includes metal piercing blades with sets of teeth on either end thereof. The piercing blades are mounted in housing members (e.g., along with environmental sealing components). The housing members are clamped about the insulated main and tap cables so that one set of teeth of a piercing blade engages the main cable and the other set of teeth of the piercing blade engages the tap cable. The teeth penetrate the insulation layers of the cables and make contact with the underlying conductors, thereby providing electrical continuity between the conductors through the piercing blade.

SUMMARY OF THE INVENTION

According to further embodiments of the present invention, an electrical connector for mechanically and electrically connecting first and second cables, the first cable including an elongate first electrical conductor covered by a first insulation layer, the second cable including an elongate second electrical conductor covered by a second insulation layer, includes a connector body, an electrically conductive first insulation piercing feature on the connector body, an electrically conductive second insulation piercing feature on the connector body and electrically connected to the first insulation piercing feature, and an electrically conductive third insulation piercing feature on the connector body. The first insulation piercing feature is configured to pierce through the first insulation layer and electrically engage the first electrical conductor. The second insulation piercing feature is configured to pierce through the second insulation layer and electrically engage the second electrical conductor. The third insulation piercing feature is located and configured to pierce through the first insulation layer and electrically engage the first electrical conductor on a side opposite the first insulation piercing feature to provide a low resistance current path between strands of the first electrical conductor. The electrical connector is configured such that, when the electrical connector is installed on the first and second cables, the third insulation piercing feature is substantially only electrically connected to the second electrical conductor through the first electrical conductor.

According to method embodiments of the present invention, a method for mechanically and electrically connecting first and second cables, the first cable including an elongate first electrical conductor covered by a first insulation layer, the second cable including an elongate second electrical conductor covered by a second insulation layer, includes providing an electrical connector including a connector body, an electrically conductive first insulation piercing feature on the connector body, an electrically conductive second insulation piercing feature on the connector body and electrically connected to the first insulation piercing feature, and an electrically conductive third insulation piercing feature on the connector body. The first insulation piercing feature is configured to pierce through the first insulation layer and electrically engage the first electrical conductor. The second insulation piercing feature is configured to pierce through the second insulation layer and electrically engage the second electrical conductor. The third insulation piercing feature is located and configured to pierce through the first insulation layer and electrically engage the first electrical conductor on a side opposite the first insulation piercing feature. The method further includes installing the connector on the first and second cables such that: the first insulation piercing feature electrically engages the first electrical conductor; the second insulation piercing feature electrically engages the second electrical conductor to provide electrical continuity between the first and second electrical conductors through the first and second insulation piercing features; the third insulation piercing feature electrically engages and provides a low resistance current path between strands of the first electrical conductor; and the third insulation piercing feature is substantially only electrically connected to the second electrical conductor through the first electrical conductor.

According to embodiments of the present invention, an electrical connector for mechanically and electrically connecting first and second cables, the first cable including an elongate first electrical conductor covered by a first insulation layer, the second cable including an elongate second electrical conductor covered by a second insulation layer, includes a connector body, an electrically conductive first insulation piercing feature on the connector body, an electrically conductive second insulation piercing feature on the connector body and electrically connected to the first insulation piercing feature, and a compression mechanism. The connector body includes first, second and third body members including axially spaced apart first, second and third jaw portions, respectively. A first cable slot is defined between the first and third jaw portions to receive the first cable. A second cable slot is defined between the second and third jaw portions to receive the second cable. The first and second body members are telescopingly arranged to permit the first and second body members to slide relative to one another along a slide axis. The first insulation piercing feature is configured to pierce through the first insulation layer and electrically engage the first electrical conductor. The second insulation piercing feature is configured to pierce through the second insulation layer and electrically engage the second electrical conductor. The compression mechanism is configured and operable to apply a clamping load along a clamping axis extending through both of the first and second electrical conductors to force the first insulation piercing feature into electrical engagement with the first electrical conductor and to force the second insulation piercing feature into electrical engagement with the second electrical conductor to thereby provide electrical continuity between the first and second electrical conductors. The first, second and third jaw portions are relatively slideable along the slide axis substantially parallel with the clamping axis to independently adjust the sizes of the first and second cable slots when the compression mechanism is operated to apply the clamping load along the clamping axis.

According to method embodiments of the present invention, a method for mechanically and electrically connecting first and second cables, the first cable including an elongate first electrical conductor covered by a first insulation layer, the second cable including an elongate second electrical conductor covered by a second insulation layer, includes providing an electrical connector including a connector body, an electrically conductive first insulation piercing feature on the connector body, an electrically conductive second insulation piercing feature on the connector body and electrically connected to the first insulation piercing feature, and a compression mechanism. The connector body includes first, second and third body members including axially spaced apart first, second and third jaw portions, respectively. A first cable slot is defined between the first and third jaw portions to receive the first cable. A second cable slot is defined between the second and third jaw portions to receive the second cable. The first and second body members are telescopingly arranged to permit the first and second body members to slide relative to one another along a slide axis. The first insulation piercing feature is configured to pierce through the first insulation layer and electrically engage the first electrical conductor. The second insulation piercing feature is configured to pierce through the second insulation layer and electrically engage the second electrical conductor. The compression mechanism is configured and operable to apply a clamping load along a clamping axis. The method further includes: placing the first and second cables in the electrical connector such that the first and second electrical conductors are aligned along the clamping axis; and operating the compression mechanism to apply the clamping load along the clamping axis extending through both of the first and second electrical conductors to force the first insulation piercing feature into electrical engagement with the first electrical conductor and to force the second insulation piercing feature into electrical engagement with the second electrical conductor to thereby provide electrical continuity between the first and second electrical conductors. The first, second and third jaw portions are relatively slideable along the slide axis substantially parallel with the clamping axis to independently adjust the sizes of the first and second cable slots when the compression mechanism is operated to apply the clamping load along the clamping axis.

According to further embodiments of the present invention, an electrical connector for mechanically and electrically connecting first and second cables, the first cable including an elongate first electrical conductor covered by a first insulation layer, the second cable including an elongate second electrical conductor covered by a second insulation layer, includes a connector body, an electrically conductive first insulation piercing feature on the connector body, an electrically conductive second insulation piercing feature on the connector body and electrically connected to the first insulation piercing feature, and a compression mechanism. The first insulation piercing feature is configured to pierce through the first insulation layer and electrically engage the first electrical conductor. The second insulation piercing feature is configured to pierce through the second insulation layer and electrically engage the second electrical conductor. The compression mechanism includes a flexible compression strap and a tensioning mechanism. The tensioning mechanism is operable to apply a tension load to the flexible compression strap to force the first and second electrical conductors into electrical engagement with the first and second insulation piercing features to thereby provide electrical continuity between the first and second electrical conductors.

According to method embodiments of the present invention, a method for mechanically and electrically connecting first and second cables, the first cable including an elongate first electrical conductor covered by a first insulation layer, the second cable including an elongate second electrical conductor covered by a second insulation layer, includes providing an electrical connector a connector body, an electrically conductive first insulation piercing feature on the connector body, an electrically conductive second insulation piercing feature on the connector body and electrically connected to the first insulation piercing feature, and a compression mechanism. The first insulation piercing feature is configured to pierce through the first insulation layer and electrically engage the first electrical conductor. The second insulation piercing feature is configured to pierce through the second insulation layer and electrically engage the second electrical conductor. The compression mechanism includes a flexible compression strap and a tensioning mechanism. The tensioning mechanism is operable to apply a tension load to the flexible strap. The method further includes: placing the first and second cables in the electrical connector; and operating the tensioning mechanism to apply the tension load to the flexible strap to force the first and second electrical conductors into electrical engagement with the first and second insulation piercing features to thereby provide electrical continuity between the first and second electrical conductors.

According to further embodiments of the present invention, an electrical connector for mechanically and electrically connecting first and second cables, the first cable including an elongate first electrical conductor covered by a first insulation layer, the second cable including an elongate second electrical conductor covered by a second insulation layer, includes an intermediate body member, a first clamp body pivotably or bendably joined to the intermediate body member, a second clamp body pivotably or bendably joined to the intermediate body member, an electrically conductive first insulation piercing feature on the connector body, an electrically conductive second insulation piercing feature on the connector body and electrically connected to the first insulation piercing feature, and a compression mechanism. The intermediate body member has first and second opposed cable seats. The first cable seat and the first clamp body define a first cable receiving slot. The second cable seat and the second clamp body define a second cable receiving slot. The first insulation piercing feature extends from the first cable seat into the first cable receiving slot and is configured to pierce through the first insulation layer and electrically engage the first electrical conductor. The second insulation piercing feature extends from the second cable seat in an opposing direction and into the second cable receiving slot and is configured to pierce through the second insulation layer and electrically engage the second electrical conductor. The compression mechanism is configured to force the first and second clamp bodies against the first and second cables to force the first and second cables into electrical engagement with the first and second insulation piercing features to thereby provide electrical continuity between the first and second electrical conductors. The first and second clamp bodies are flexible to permit the first and second clamp bodies to deform about the first and second cables.

According to method embodiments of the present invention, a method for mechanically and electrically connecting first and second cables, the first cable including an elongate first electrical conductor covered by a first insulation layer, the second cable including an elongate second electrical conductor covered by a second insulation layer, includes providing an electrical connector including an intermediate body member, a first clamp body pivotably or bendably joined to the intermediate body member, a second clamp body pivotably or bendably joined to the intermediate body member, an electrically conductive first insulation piercing feature on the connector body, an electrically conductive second insulation piercing feature on the connector body and electrically connected to the first insulation piercing feature, and a compression mechanism. The intermediate body member has first and second opposed cable seats. The first cable seat and the first clamp body define a first cable receiving slot. The second cable seat and the second clamp body define a second cable receiving slot. The first insulation piercing feature extends from the first cable seat into the first cable receiving slot and is configured to pierce through the first insulation layer and electrically engage the first electrical conductor. The second insulation piercing feature extends from the second cable seat in an opposing direction and into the second cable receiving slot and is configured to pierce through the second insulation layer and electrically engage the second electrical conductor. The method further includes: placing the first and second cables in the first and second cable seats, respectively; and operating the compression mechanism to force the first and second clamp bodies against the first and second cables to force the first and second cables into electrical engagement with the first and second insulation piercing features to thereby provide electrical continuity between the first and second electrical conductors. The first and second clamp bodies are flexible to permit the first and second clamp bodies to deform about the first and second cables.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
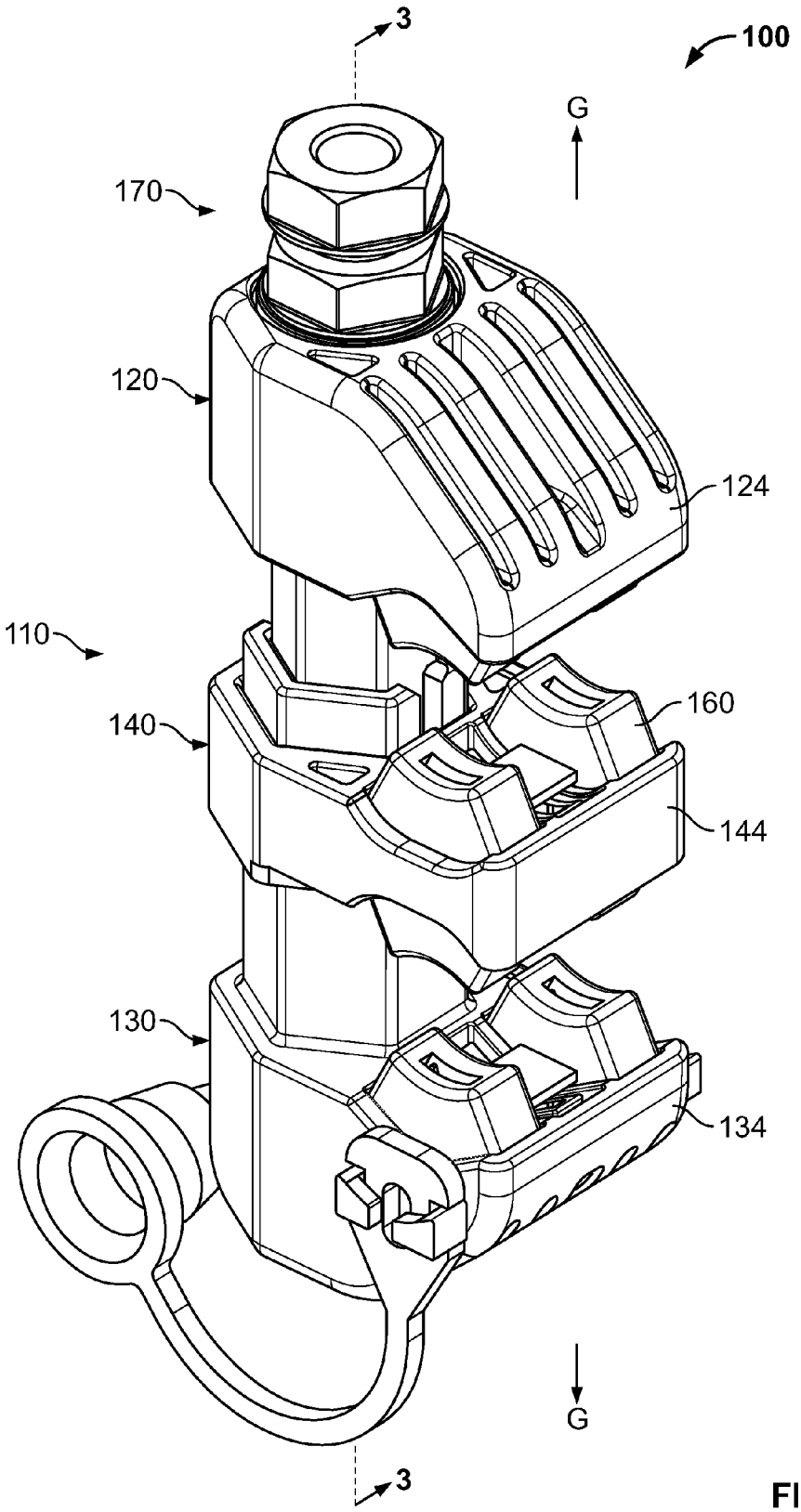
FIG. 1 is a perspective view of a connector according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-6, a multi-tap or multi-cable insulation piercing connector 100 according to embodiments of the present invention is shown therein. The connector 100 can be used to form an insulation piercing connector (IPC) connection 5 (FIGS. 4-6) including elongate electrical cables 12, 14 (e.g., electrical power lines) mechanically and electrically coupled by the connector 100. The connector 100 may be adapted for use as a tap connector for connecting an elongate tap cable 14 to an elongate main cable 12 of a utility power distribution system, for example. The connected cables 12, 14 may be other combinations of cables such as spliced cables.

The tap cable 14 (FIGS. 4 and 5), sometimes referred to as a distribution conductor, may be a known electrically conductive metal high, medium or low voltage cable or line having a generally cylindrical form in an exemplary embodiment. The main cable 12 may also be a generally cylindrical high, medium or low voltage cable line. The tap cable 14 includes a metal electrical conductor 14A surrounded by an insulation layer 14B. The main cable 12 includes a metal electrical conductor 12A surrounded by an insulation layer 12B. One or more of the conductors 12A, 14A may be formed of multiple strands (e.g., parallel or twisted strands) as illustrated in the figures, or may be solid cylindrical conductors (solid wire). Multi-strand conductors may be easier to handle with better bending characteristics. Suitable materials for the conductors 12A, 14A may include aluminum or copper. The insulation layers 12B, 14B may be formed of a polymeric material such as PVC, polypropylene, polyethylene, or cross-linked polyethylene. The tap conductor 14A and the main conductor 12A may be of the same wire gauge or different wire gauge in different applications and the connector 100 is adapted to accommodate a range of wire gauges for the tap conductor 14A and the main conductor 12A. The cable 12 has a lengthwise axis E-E and the cable 14 has a lengthwise axis F-F.

When installed to the tap cable 14 and the main cable 12, the connector 100 provides electrical connectivity between the main conductor 12A and the tap conductor 14A to feed electrical power from the main conductor 12A to the tap conductor 14A in, for example, an electrical utility power distribution system. The power distribution system may include a number of main cables of the same or different wire gauge, and a number of tap cables of the same or different wire gauge.

Figure 2:
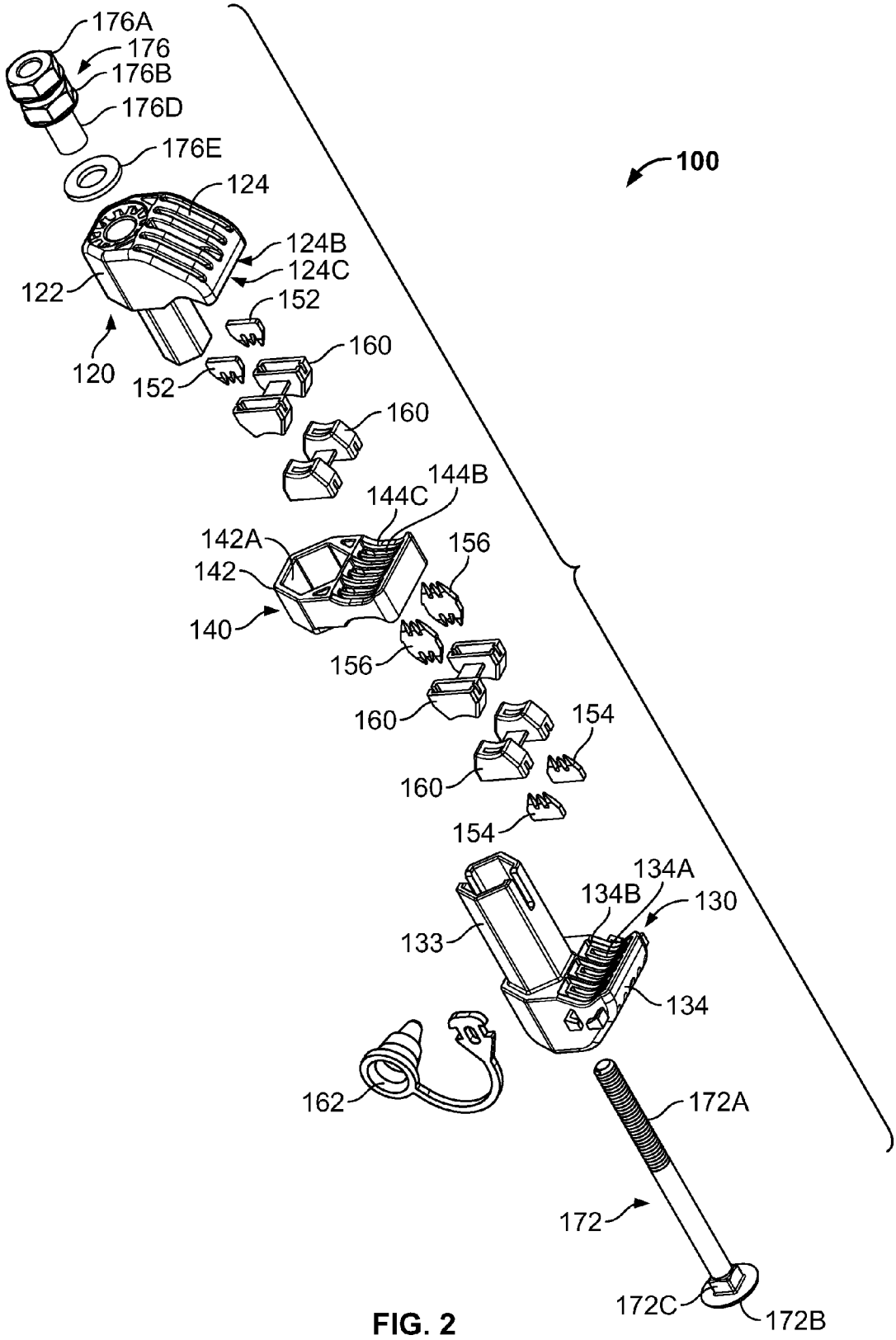
FIG. 2 is an exploded perspective view of the connector of FIG. 1.
Figure 3:
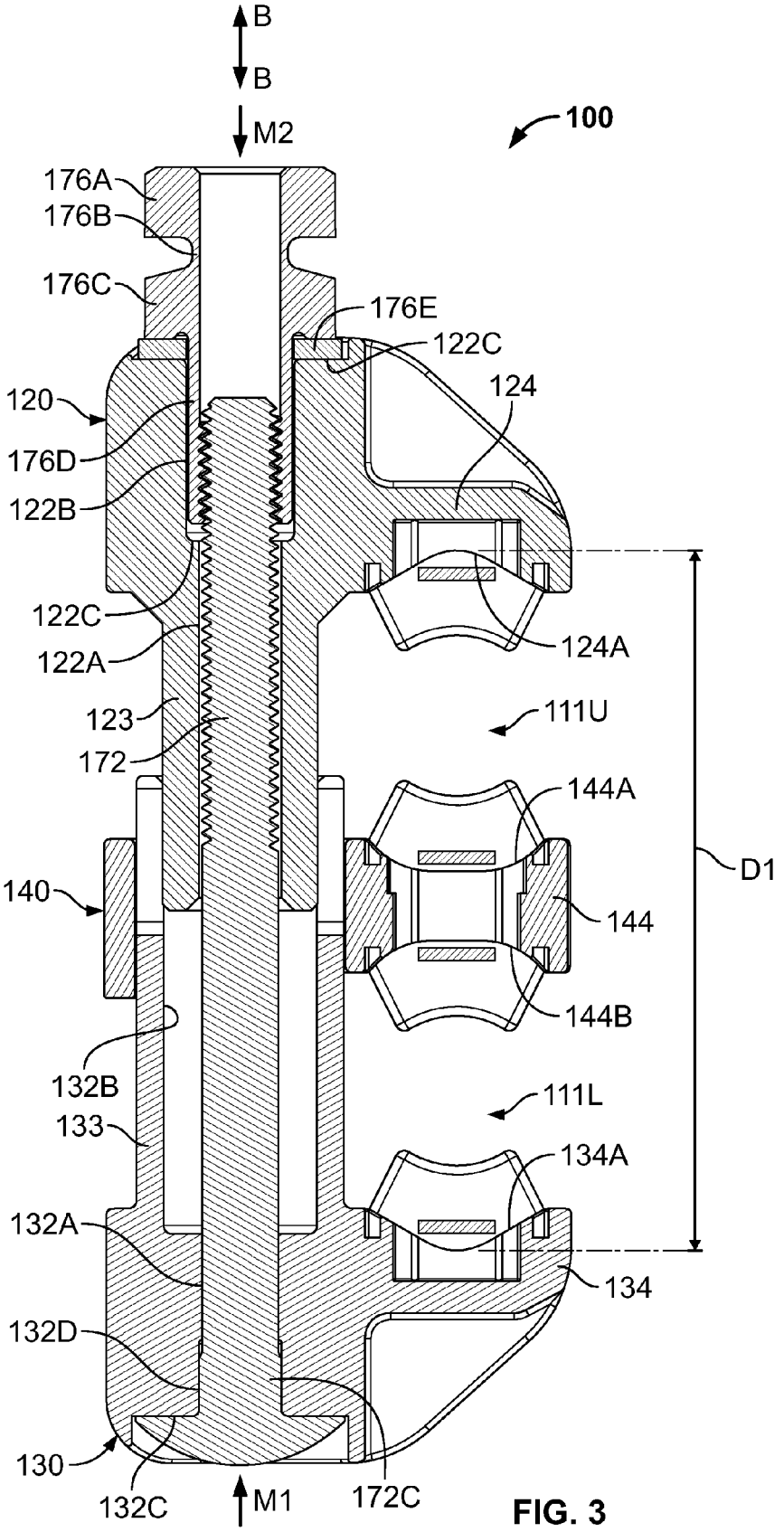
FIG. 3 is a cross-sectional view of the connector of FIG. 1 taken along the line 3-3 of FIG. 1.

With reference to FIGS. 1-3, the connector 100 includes a connector body assembly 110, a pair of upper secondary blade members 152, a pair of lower secondary blade members 154, a pair of intermediate primary blade members 156, seal members 160, a cable cap 162, and a clamping or compression mechanism 170. The connector 100 has a longitudinal axis G-G.

The connector body assembly 110 includes a first or upper body member 120, a second or lower body member 130, and a third or intermediate body member 140.

The upper body member 120 includes a support portion 122 and a leg or jaw portion 124 extending laterally from the support portion 122 with respect to the connector axis G-G. The support portion 122 includes a coupling or rail portion 123, a lower bore 122A, an enlarged diameter upper bore 122B, and an upper shoulder 122C. The jaw portion 124 includes a cable groove or seat 124A. The jaw portion 124 further includes, in the cable seat 124A, a pair of blade slots or seats 124B and a pair of seal slots or seats 124C.

The lower body member 130 includes a support portion 132 and a leg or jaw portion 134 extending laterally from the support portion 132 with respect to the connector axis G-G. The support portion 132 includes a coupling or rail portion 133, a lower bore 132A, an enlarged diameter upper bore 132B, a shoulder 132C, and a socket 132D. The jaw portion 134 includes a cable groove or seat 134A. The jaw portion 134 further includes, in the cable seat 134A, a pair of blade slots or seats 134B and a pair of seal slots or seats 134C.

The intermediate body member 140 includes a support portion 142 and a double sided leg or jaw portion 144. A through bore 142A is defined in the support portion 142. The jaw portion 144 includes a pair of axially opposed cable grooves or seats 144A, 144D. The jaw portion 144 further includes, in and between the cable seats 144A, 144D, a pair of blade slots or seats 144B and two pairs (one pair on each side) of seal slots or seats 144C.

The jaw portion 124 and the jaw portion 144 define an upper cable receiving slot 111U therebetween. The jaw portion 134 and the jaw portion 144 define a lower cable receiving slot 111L therebetween. The rail portion 123 of the upper body member 120 is received or nested in the bore 132B of the lower body member 130 to permit the upper body member 120 to telescopingly slide in and out of the lower body member 130 along a slide axis B-B. The rail portion 123 and the bore 132B have complementary geometric shapes (hexagonal) to prevent or limit relative rotation between the body members 120, 130. In this way, the spacing distance D1 (FIG.

3) between the cable seats 124A, 134A can be varied. The intermediate body member 140 is slideably mounted on the lower body member 130 (which extends through the bore 142A) to permit the intermediate body member 140 to slide up and down the lower body member 130 along the slide axis B-B. Accordingly, the heights of the slots 111U, 111L can be independently varied. The rail portion 133 and the bore 142A have complementary geometric shapes (hexagonal) to prevent or limit relative rotation between the body members 130, 140. The telescoping arrangement between the body members 120, 130 and the mechanical restraints on rotation between the body members 120, 130 and between the body members 130, 140 can enhance the stability and strength of the connector 100.

The body members 120, 130, 140 may be formed of any suitable material. According to some embodiments, the body members 120, 130, 140 are formed of a polymeric material. In some embodiments, the polymeric material is selected from the group consisting of polyamide (PA) 6.6, PA 6.6 reinforced with glass fibers or talc, polycarbonate, or polycarbonate blend. The body members 120, 130, 140 may be formed using any suitable technique. According to some embodiments, the body members 120, 130, 140 are molded. According to some embodiments, the each of the body members 120, 130, 140 is monolithic and unitarily formed.

With reference to FIGS. 2 and 3, the compression mechanism 170 includes a bolt 172, and a torque control member in the form of a shear nut 176. The bolt 172 may be a carriage bolt and includes a threaded shank 172A, a head 172B, and a faceted (e.g., square) shoulder portion 172C. The shear nut 176 includes a shear head 176A, a base portion 176B, a shear or breakaway section 176C coupling the portions 176A and 176B, a tubular, internally threaded extension 176D depending from the base portion 176B, and a washer 176E.

The bolt 172 extends through the bores 132A, 132B, 122A and is axially constrained by the bolt head 172B and the shoulder 132C. The bolt 172 is also rotationally fixed by the socket 132D, which has a noncircular shape (e.g., square-shaped) that is complementary to the shape of the bolt shoulder 172C. The shear nut 176 is rotatably mounted on the bolt 172 such that the threaded shank 172A threadedly engages the extension 176D and the base portion 176B is axially constrained by the shoulder 122C.

In use, the shear head 176A is engaged by a driver and forcibly rotated thereby. The shear nut 176 is thereby rotated relative to the axially and rotationally constrained bolt 172. This causes the bolt 172 to translate up the extension 176D, which slides or translates the body portions 120 and 130 together (in respective directions M1 and M2) along the slide axis B-B. The shear head 176A will shear off of the base portion 176B at the breakaway section 176C when subjected to a prescribed torque.

According to some embodiments, the bolt 172 is formed of steel (e.g., galvanized steel or stainless steel). According to some embodiments, the shear nut 176 is formed of aluminum alloy, plastic or zinc alloy.

Figure 5:
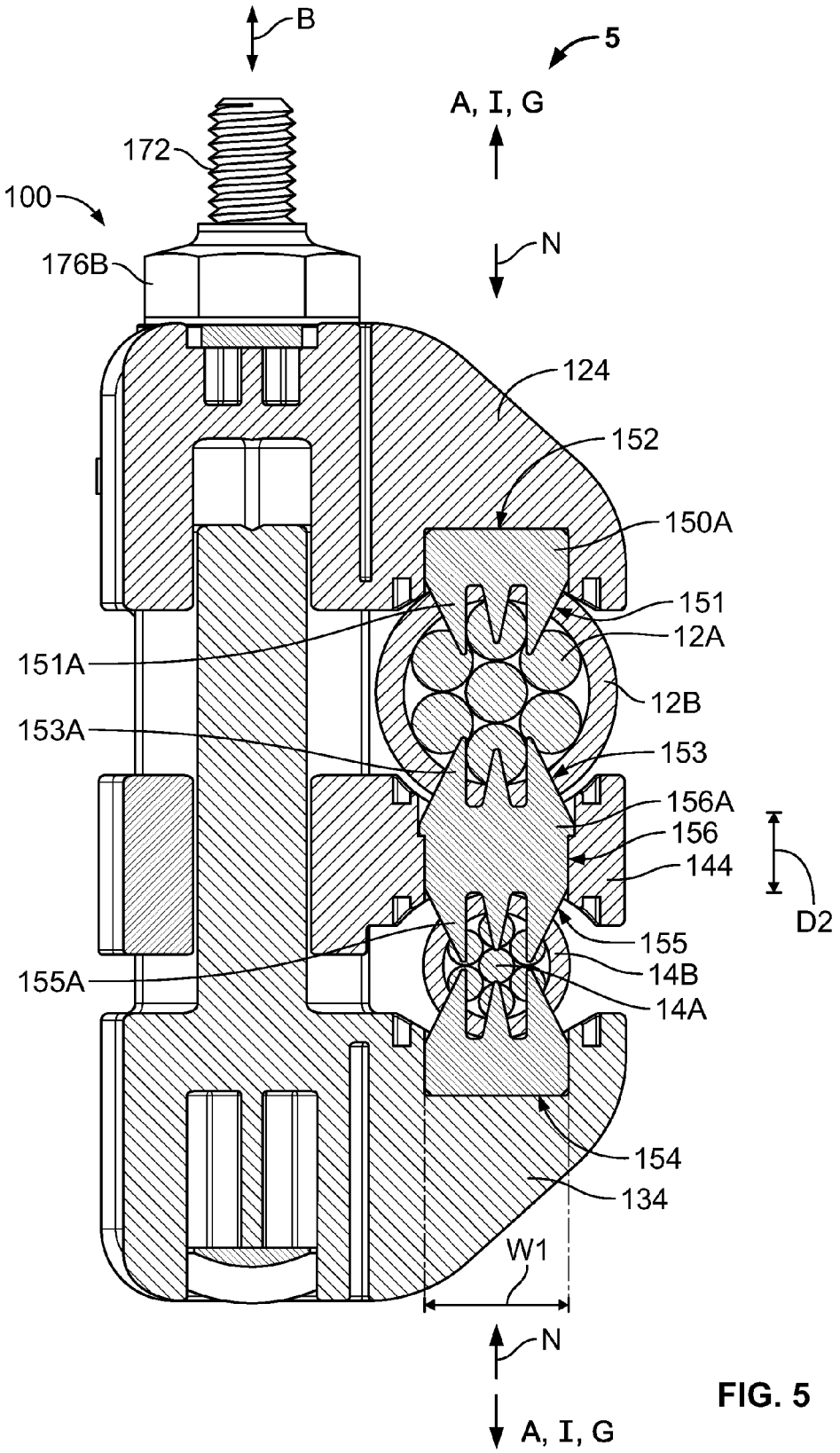
FIG. 5 is a cross-sectional view of the connection of FIG. 4 taken along the line 5-5 of FIG. 4.

According to some embodiments and as illustrated, the blade members 152, 154 are identically formed. However, in some embodiments, the blade members 152, 154 may be configured differently from one another. With reference to FIG. 5, each blade member 152, 154 includes a body or base 150A and integral cable engagement or insulation piercing feature 151 located on the outer edge of the base 150A. The insulation piercing feature 151 includes a plurality of serrations or teeth 151A (as shown, three) separated by slots and having terminal points. The points of the teeth 151A collectively lie on an arc generally corresponding to the profile of the arcuate outer surface of the corresponding cable conductor 12A, 14A.

Each intermediate blade member 156 includes an upper insulation piercing feature 153 and an opposing lower insulation piercing feature 155 extending from opposed edges of an integral connecting body or base 156A. The insulation piercing feature 153 includes a plurality of serrations or teeth 153A (as shown, three) separated by slots and having terminal points. Likewise, the insulation piercing feature 155 includes a plurality of teeth 155A (as shown, three) separated by slots and having terminal points. The points of the teeth 153A, 155A collectively lie on an arc generally corresponding to the profile of the arcuate outer surface of the corresponding cable conductor 12A, 14A.

The upper blade members 152 are affixed in the blade seats 124B such that their teeth 151A face the intermediate body member 140. The lower blade members 154 are affixed in the blade seats 134B such that their teeth 151A face the intermediate body member 140. The blade members 156 are affixed in the blade seats 144B such that the teeth 153A face or oppose the teeth 151A of the blade members 152 and the teeth 155A face or oppose the teeth 151A of the blade members 154. The connecting portions 156A of the blade members 156 extend fully and directly axially (with respect to the connection axis G-G) through the jaw portion 144.

According to some embodiments, the width W1 (FIG. 5) of each blade member 152, 154, 156 is at least ten times its thickness. According to some embodiments, the thickness of each the blade member 152, 154, 156 is between about 0.20 mm and 5.0 mm.

The blade members 152, 154, 156 may be formed of any suitable electrically conductive material. According to some embodiments, the blade members 152, 154, 156 are formed of metal. According to some embodiments, the blade members 152, 154, 156 are formed of aluminum, aluminum alloy, or copper and may be galvanized. The blade members 152, 154, 156 may be formed using any suitable technique. According to some embodiments, each blade members 152, 154, 156 is monolithic and unitarily formed. According to some embodiments, each blade member 152, 154, 156 is extruded and cut, stamped (e.g., die-cut), cast and/or machined.

The seal members 160 cover the blade members 152, 154, 156 and are affixed in respective seal seats 124C, 134C, 144C. The seal members 160 may be formed of any suitable material. According to some embodiments, the seal members 160 are formed of an elastomeric material. In some embodiments, the elastomeric material is selected from the group consisting of rubber, polypropylene, PVC, silicone, neoprene, santoprene, EPDM, or EPDM and polypropylene blend. The seal members 160 may be formed using any suitable technique. According to some embodiments, the seal members 160 are molded. According to some embodiments, each of the seal members 160 is monolithic and unitarily formed.

Figure 4:
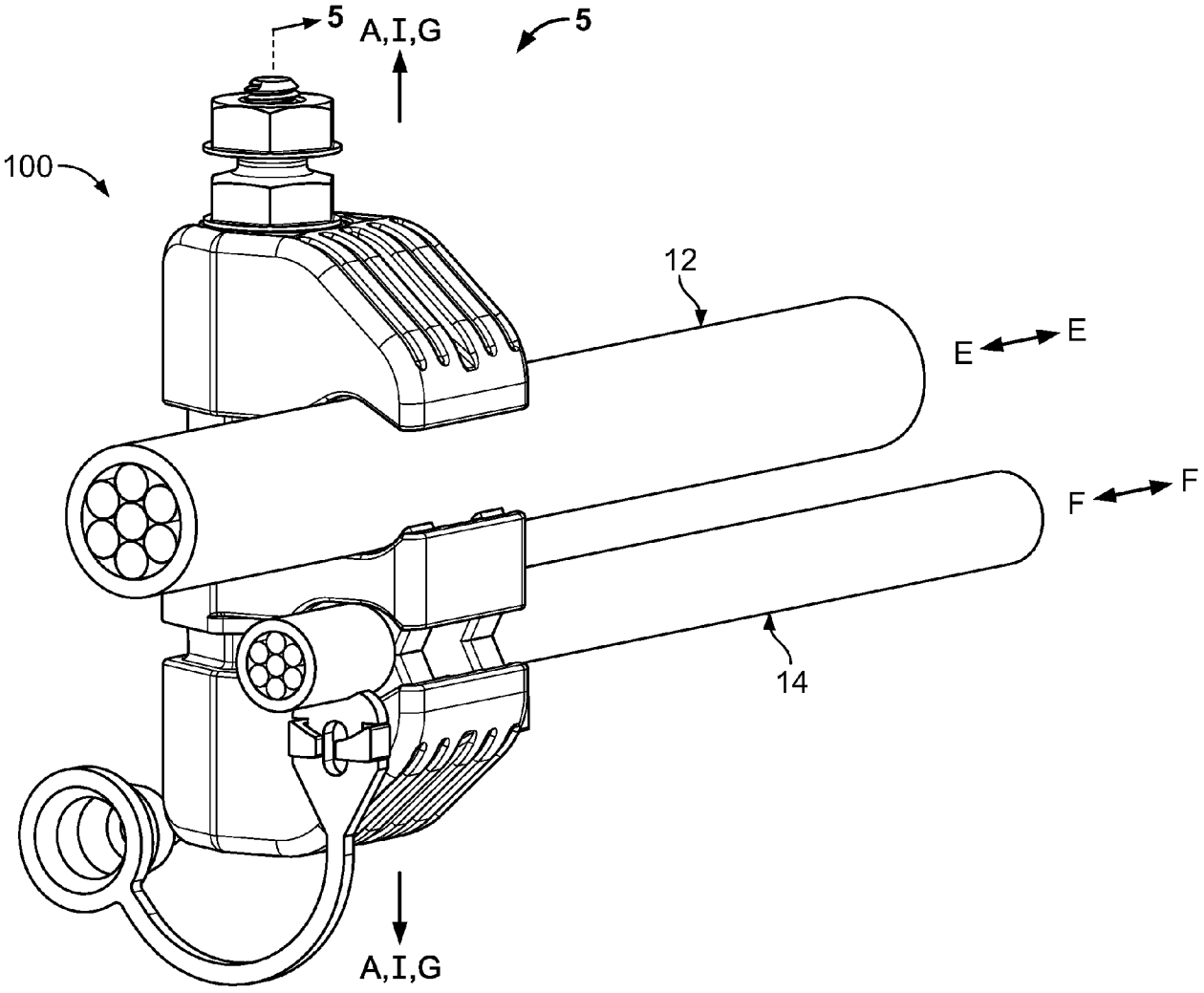
FIG. 4 is a perspective view of a connection including the connector of FIG. 1.

With reference to FIGS. 4 and 5, exemplary methods for using the connector assembly 100 in accordance with embodiments of the present invention will now be described.

If necessary, the compression mechanism 170 is loosened or opened to permit the jaw portions 124, 134, 144 (and thereby the blade members 152, 154, 156) to be separated. The main cable 12 (with the insulation layer 12B covering the conductor 12A) is inserted in or between the cable grooves 124A, 144A and the tap cable 14 (with the insulation layer 14B covering the conductor 14A) is inserted in or between the cable grooves 134A, 144D. The cables 12, 14 can be axially or laterally inserted into the slots defined between the jaws.

The shear nut 176 is then driven to compress the compression mechanism 170 along the slide axis B-B and thereby drive the jaws 124, 134 together along a clamping axis A-A parallel to the slide axis B-B. The shear nut 176 is driven until a prescribed torque is applied, whereupon the shear head 176A will break off at the shear section 176C, thereby helping to ensure that the proper load is applied to the blade members 152, 154, 156. The intermediate body member 140 is free to slide relative to the body members 120, 130 along the slide axis B-B, which enables the connector 100 to automatically adjust the spacing D1 between the jaw portions 124, 134, 144 to accommodate different combinations of cable 12, 14 sizes. The connector 100 can thereby accommodate a variety of cable size combinations, including cables of the same size (e.g., for splicing connections) and cables of different sizes (e.g., for tapping connections).

As a result, the insulation piercing features 151 and 153 of the opposed pairs of the blade members 152 and 156 are driven to converge on and capture the cable 12 therebetween, and the insulation piercing features 151 and 155 of the opposed pairs of the blade members 154 and 156 are driven to converge on and capture the cable 14 therebetween. More particularly, the teeth 151A, 153A of each blade member 152, 156 are forced through the insulation layer 12B and into mechanical and electrical contact with the conductor 12A, and the teeth 151A, 155A of each blade member 154, 156 are forced through the insulation layer 14B and into mechanical and electrical contact with the conductor 14A. The teeth 151A, 153A, 155A embed in the insulation layers 12B, 14B and make electrical and mechanical contact or engagement with the conductors 12A, 12B. In the foregoing manner, the connector assembly 100 is operatively connected to the cables 12, 14 and the conductors 12A, 14A are electrically connected to one another without stripping the insulation layers 12B, 14B.

According to some embodiments, the teeth 151A, 153A, 155A embed in the conductors 12A, 14A (as discussed in more detail below with reference to FIG. 6). According to some embodiments, the teeth 151A, 153A, 155A embed into the conductors 12A, 14A a distance of at least about 0.5 mm.

The seal members 160 engage and form an environmental seal about the sections of the cables 12, 14 perforated by the teeth 151A, 153A, 155A.

The telescoping configuration of the body members 120, 130 and the anti-rotation mechanisms or arrangements between the body members 124, 134, 144 can prevent or inhibit misalignment of the blade members 152, 154, 156, which should be substantially straight along the clamping axis A-A to properly embed in the cables 12, 14. The telescoping rails 123, 133 can inhibit relative rotation and cocking. By confining the bolt 172 in the bores of the rails 123, 133, the bolt 172 can be better electrically isolated from the conductors 12A, 14A. The enhanced strength and stability afforded by the telescoping, rotation-limited configuration can compensate for the inherent imbalance caused by locating the jaw portions on only one side of the clamping bolt thereby permitting the more compact form factor.

In the foregoing manner, the connection 5 (FIGS. 4-6) can be formed. The blade members 152, 154, 156 provide electrical continuity (i.e., a path for electrical current flow) between the conductors 12A, 14A of the cables 12, 14. The connector 100 mechanically secures the cables 12, 14 relative to one another. Moreover, the connector 100 provides environmental protection for the locations in the insulation layers 12B, 14B pierced by the blade members 152, 154, 156.

The mechanical configuration of the connector 100 enables the conductors 12A, 14A to be electrically connected with a current flow path directly through a blade member 156 having a relatively short bridging or connecting portion 156A. In particular, the connecting portion 156A can be substantially shorter than the connecting portion in the conductive blades of certain known IP connectors that clamp two cables on either lateral side of a clamping mechanism with a clamping bolt extending between the cables. By reducing the conduction path between the conductors 12A, 14A, the connector 100 can provide reduced electrical resistance, which can in turn reduce heat generation and power loss in the connector 100. According to some embodiments, the length D2 (FIG. 5) of each connecting portion 156A is less than 30 mm and, in some embodiments, less than 10 mm.

With reference to FIGS. 4 and 5, it can be seen that the installed cables 12, 14 are arranged such that they are aligned with one another along a cable alignment axis I-I (e.g., the cable 12 is stacked indirectly on top of the cable 14), which may be transverse (e.g., perpendicular) to the cable axes E-E, F-F. When the connector 100 is closed on the cables 12, 14 as described above, the opposed jaw portions 124, 134 apply a compressive clamping load N along a clamping load axis A-A substantially parallel to the connection axis G-G and the slide axis B-B. The cable alignment axis I-I is parallel to, and in some embodiments substantially coincident (i.e., coaxial) with, the clamping load axis A-A. That is, the clamping load N is applied through a clamping load axis A-A that extends through both connected cables 12, 14. By stacking the cables 12, 14 in series along the load axis A-A in this manner, the total clamping load required is reduced (e.g., by about half) as compared to prior art IP connectors wherein each of two connected cables is compressively loaded along a different respective load axis. As a result, less torque must be applied to the compression mechanism to effect the desired clamping load on each cable 12, 14. Moreover, the mechanical forces may be more effectively distributed along the connection components. According to some embodiments and as illustrated, the cable alignment axis I-I is laterally offset from slide axis B-B.

The secondary blade members 152, 154 can provide improved electrical continuity between the cables and a smaller connector form factor. With reference to FIG. 5, it can be seen that while the IP features 153, 155 are electrically connected by the connecting portion 156A of the primary blade member 156, the secondary blade member 152 is only connected to the other blade members 154, 156 and the opposing cable conductor 14A through the cable conductor 12A. Similarly, the secondary blade member 154 is only connected to the other blade members 152, 156 and the opposing cable conductor 12A through the cable conductor 14A. Thus, the blade members 152, 154 may be regarded as dead end conductor members.

While the secondary blade members 152, 154 do not conduct electricity directly between the conductors 12A, 14A, they do provide low electrical resistance flow paths through the connector 100 between the conductors 12A, 14A for strands of the conductors 12A, 14A that may otherwise have higher resistance flow paths through the connector 100. In this way, the blade members 152, 154 can equalize current flow through the strands. FIG. 6 is a fragmentary, cross-sectional schematic view showing an exemplary installation of the connector 100. As illustrated, the conductor 12A has seven electrically conductive strands J1-J7 and the conductor 14A has seven electrically conductive strands K1-K7. That is, the IP features 153, 155 (e.g., the teeth 153A, 155A) pierce and are embedded in the outer surfaces of the strands, thereby penetrating through oxidation or other contaminants that may reside on the stand surface. As such, the primary blade member 156 provides a relatively low resistance flow path between some, but not all, of the strands.

However, in the absence of the secondary blade members 152, 154, some of the strands would only be electrically connected to the other strands by strand to strand surface contact. Because the surfaces of the strands may be covered with oxidation and other insulative or dielectric matter, the surface to surface conductivity may suffer from relatively high resistance. Therefore, a low resistance path would not be provided between some of the strands of the opposing conductors 12A, 14A.

The secondary blade members 152, 154 can solve this problem in whole or in part. The secondary blade members 152, 154 function as shorting connectors or jumpers that electrically short the strands of the associated conductor 12A, 14A to one another. The secondary blade members 152 provide a low resistance flow path (through the secondary blade members 152) between the strands pierced thereby. Likewise, the secondary blade members 154 provide a low resistance flow path (through the secondary blade members 154) between the strands pierced thereby. Moreover, if the secondary blade member 152 and the primary blade member 156 both pierce the same strand (i.e., a common or shared strand), a low resistance flow path is provided from the strands of the conductor 12A pierced by the blade member 152 to the strands of the conductor 14A that are also pierced by the primary blade member 156. Likewise, if the secondary blade member 154 and the primary blade member 156 both pierce the same strand, a low resistance flow path is provided from the strands of the conductor 14A pierced by the blade member 154 to the strands of the conductor 12A pierced by the primary blade member 156. Thus, the blade members 152, 154, 156 and the strands of the conductors 12A, 14A may be suitably configured or networked to provide one or more low resistance pathways between strands not directly engaged by the blade members 156.

Figure 6A:
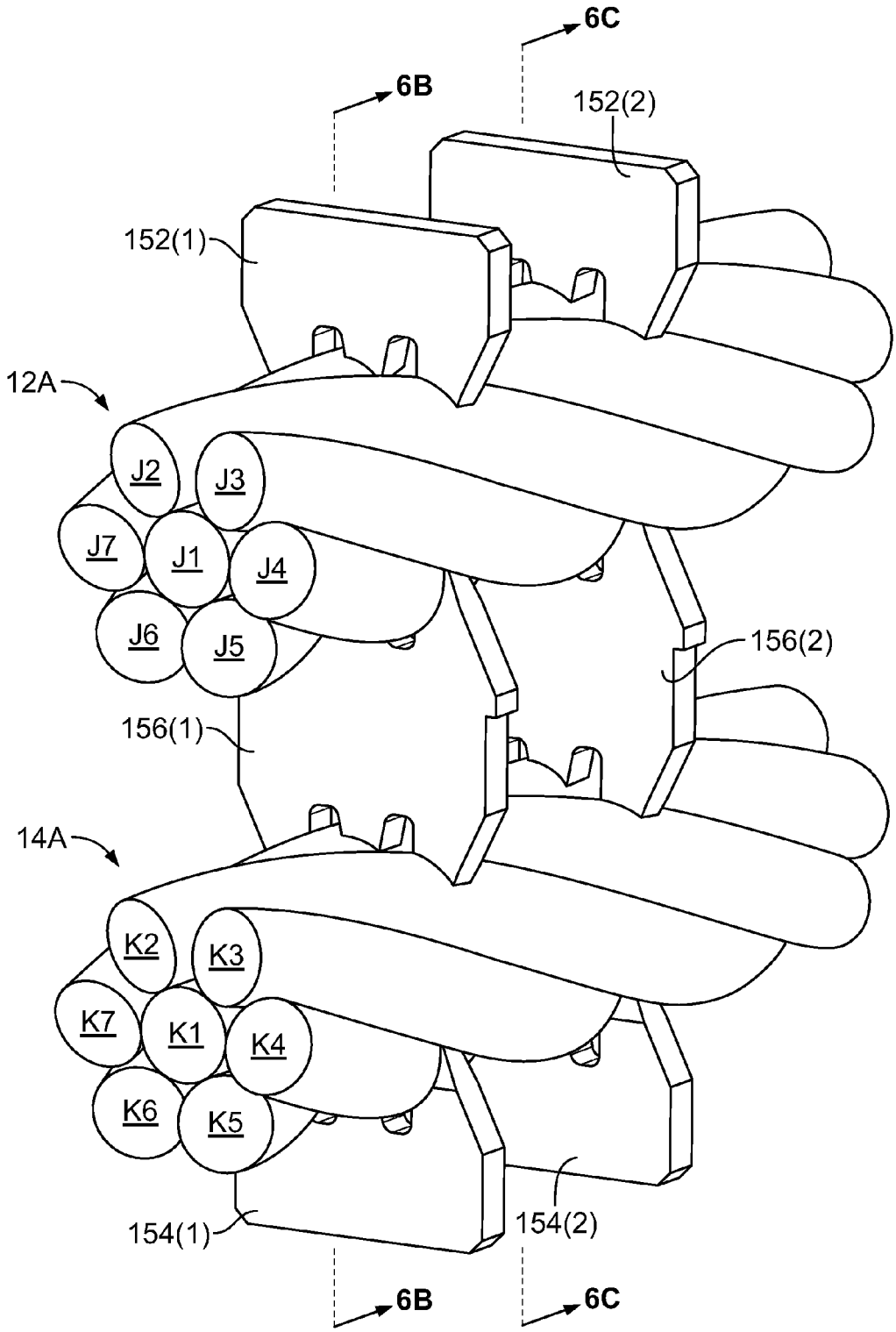
FIG. 6A is a fragmentary view of the connection of FIG. 4 illustrating engagements between conductors and blade members thereof.
Figure 6B:
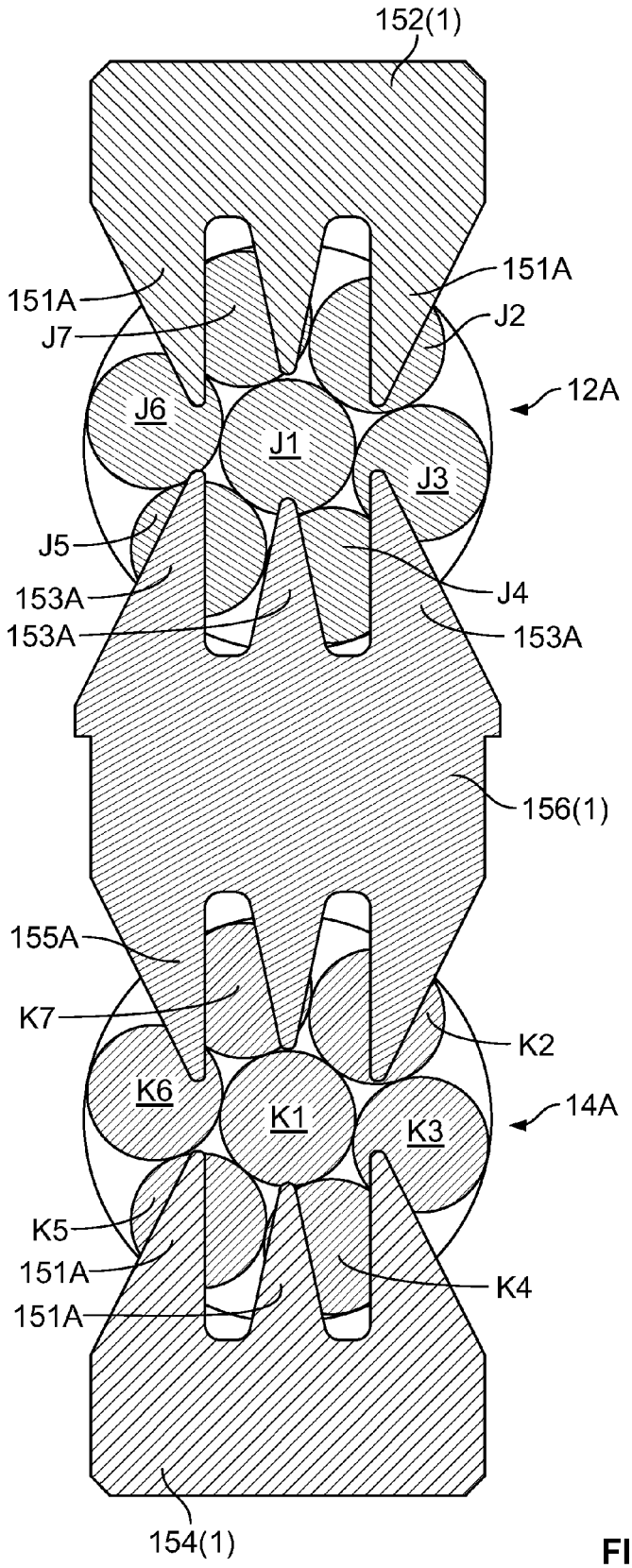
FIG. 6B is a cross-sectional view of the connection of FIG. 6A taken along the line 6B-6B thereof.
Figure 6C:
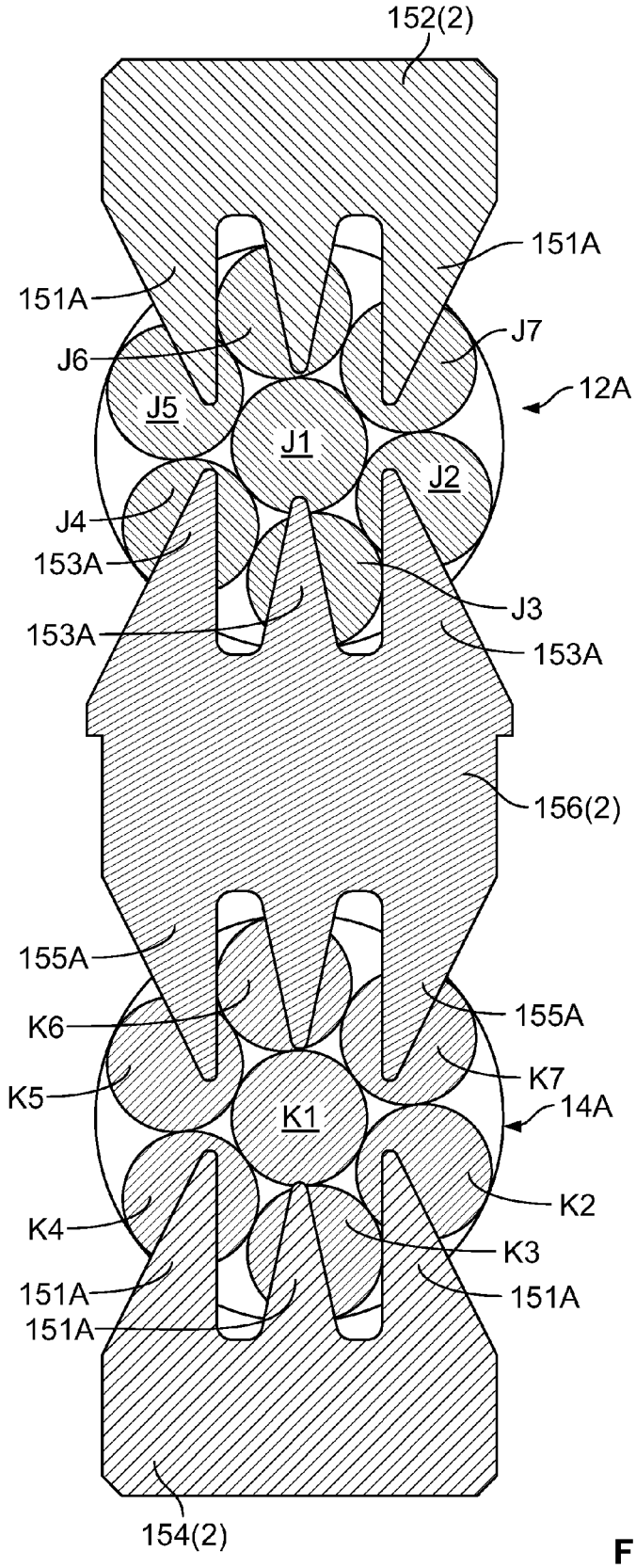
FIG. 6C is a cross-sectional view of the connection of FIG. 6A taken along the line 6C-6C thereof.

In some embodiments, two or more of each of the upper blade members 152, lower blade members 154, and middle blade members 156 may be cooperatively networked to provide such low resistance flow paths. In some embodiments, such a network may be configured to provide low resistance flow paths from all of the strands of the conductor 12A to all of the strands of the conductor 14A. An exemplary blade member and conductor network or configuration of this type is illustrated in FIGS. 6A-6C. For the purpose of description, the upper supplemental blade members are designated as a first upper blade member 152(1) and a second upper blade member 152(2), the lower blade members are designated as a first lower blade member 154(1) and a second lower blade member 154(2), and the primary intermediate blade members are designated as a first intermediate blade member 156(1) and a second intermediate blade member 156(2). As used hereinbelow, a blade member "engages" a strand when a tooth 151A, 153A, 155A thereof pierces or embeds in the strand (and through any oxidation layer) sufficiently to form a low resistance connection or contact. As used hereinbelow, strands are "connected" when a low resistance path is provided between the strands only through low resistance contacts and the conductive elements (i.e., the blade members and the strands themselves).

The following is an exemplary and nonexhaustive listing of the low resistance current pathways between the strands J1-J7 of the conductor 12A and the strands K1-K7 of the conductor 14A as shown in FIGS. 6A-6C. Strands J1, J2, J3 and J4 are directly connected to the strands K1, K5, K6 and K7 via the blade member 156(2). Strand J5 is directly connected to strands K1, K2, K6 and K7 through the blade member 156(1). Strands J6 and J7 are connected to the strands K1, K5, K6 and K7 via the blade members 152(1) and 156(2), which both engage shared strand J2. Strands K1, K5, K6 and K7 are connected to strands J1, J2, J3 and J4 via the blade member 156(2) as noted above. Strands K3 and K4 are also connected to these strands of the conductor 12A via blade members 154(1) and 156(2), which both engage shared strand K5.

While only two of each blade member 152, 154, 156 are shown in the illustrative embodiment, more blade members at each level may be desirable or necessary to ensure low resistance continuity between all strands. For example, three or more of each blade member 152, 154, 156 may be used to make connections between cables having more strands.

Thus, the secondary blade members 152, 154 can provide a low electrical resistance flow path for all strands without requiring a second primary electrical connection (i.e., a second, outboard conductive blade member that pierces strands of both conductors 12A, 14A). In particular, in a connector such as the connector 100 wherein the conductors 12A, 14A are stacked or aligned along the connector clamping axis A-A and the cable alignment axis I-I with a primary conductor connector 156 therebetween, it is not necessary to provide a second conductor connector that extends axially beyond the cables 12, 14 in order to provide low resistance flow paths for the outboard strands. This provides for a more compact connection and less material usage.

The secondary blade members 152, 154 can also enhance the durability of the connection. Thermal cycling of the connection may cause the insulation layers 12B, 14B to soften, so that, in the absence of the blade members 152, 154, some of the contact force between the connector and the cables is lost. By contrast, the blade members 152, 154 engage and mechanically load the conductors 12A, 14A to better retain the clamping load.

Figure 7:
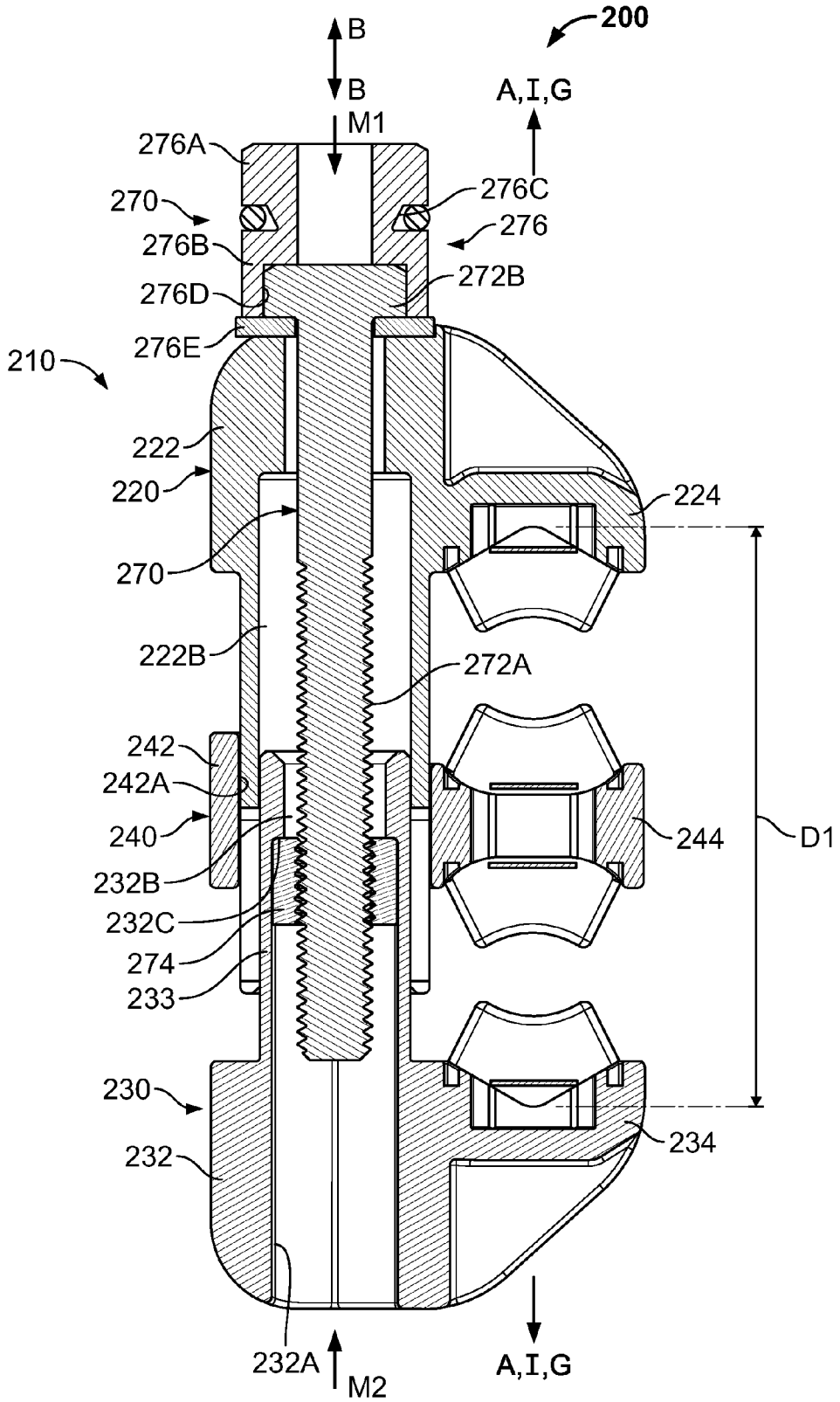
FIG. 7 is a cross-sectional view of a connector according to further embodiments of the present invention.
Figure 8:
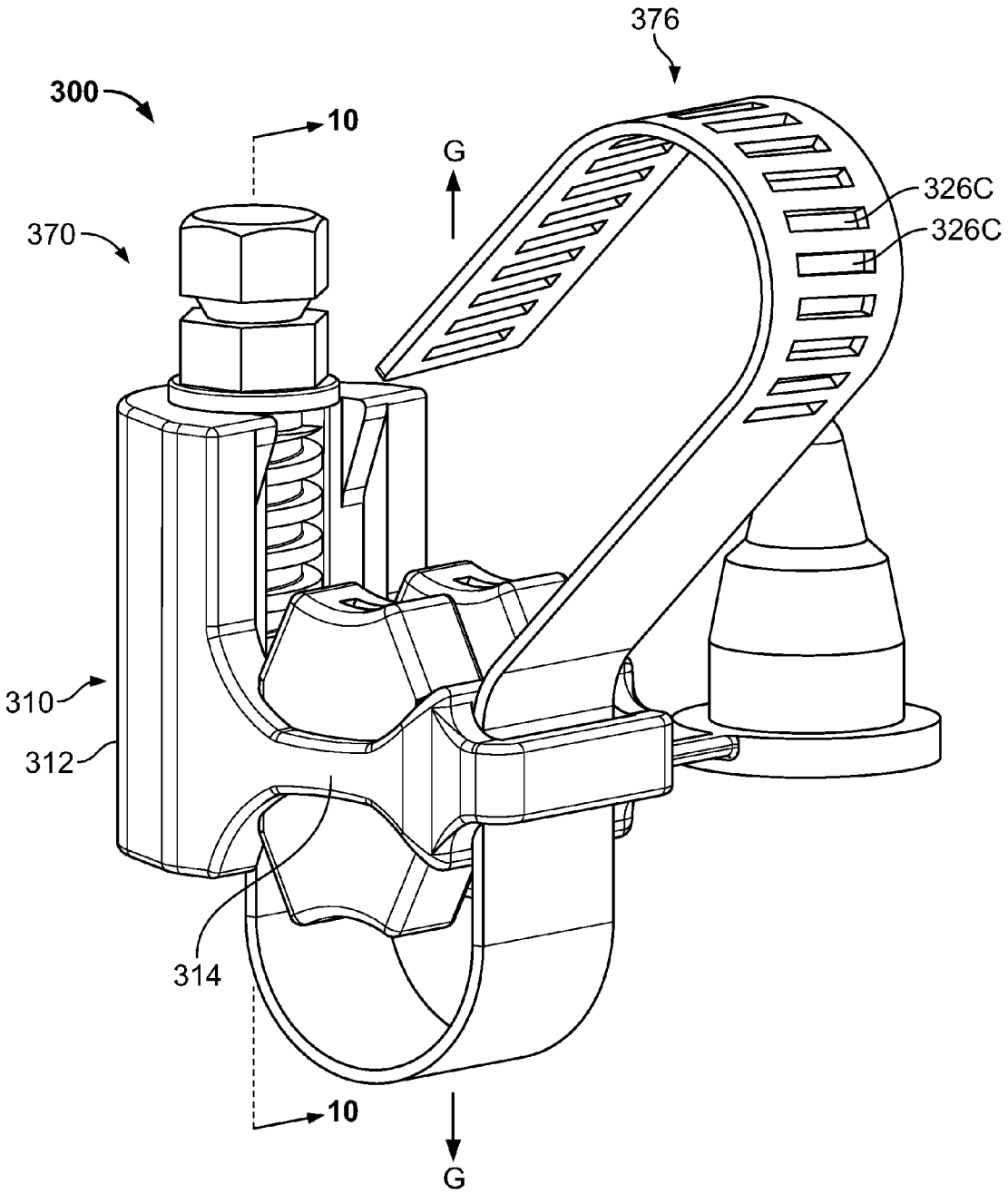
FIG. 8 is a perspective view of a connector according to further embodiments of the present invention in an open position.
Figure 9:
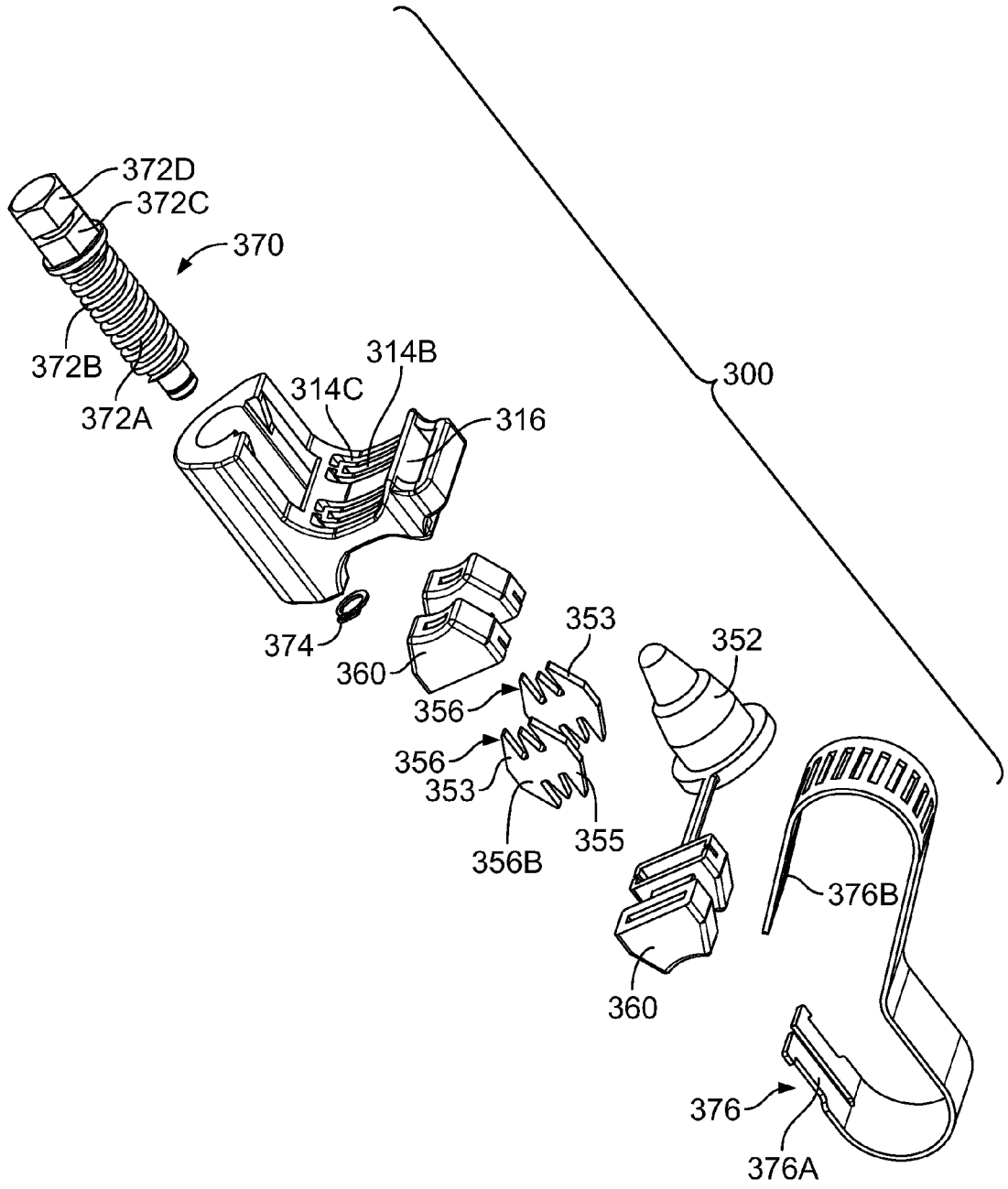
FIG. 9 is an exploded perspective view of the connector of FIG. 8.
Figure 10:
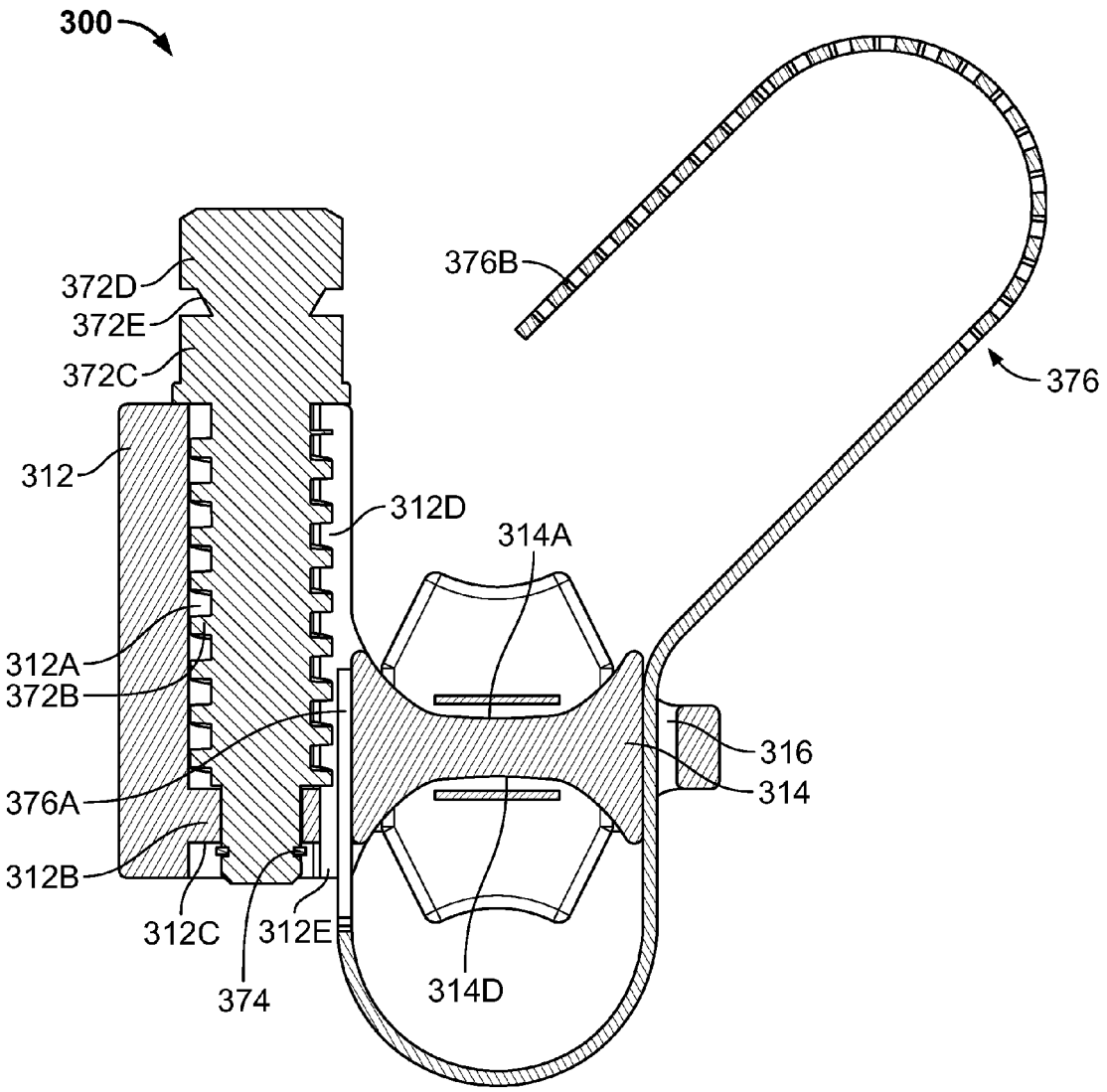
FIG. 10 is a cross-sectional view of the connection of FIG. 8 taken along the line 10-10 of FIG. 8.

With reference to FIG. 7, a multi-tap or multi-cable insulation piercing electrical connector 200 according to further embodiments of the present invention is shown therein in cross-section. The connector 200 is constructed and can be used in the same manner as the connector 100 except that the connector body assembly 210 and the compression mechanism 270 of the connector 200 are configured differently than the connector body assembly 110 and the compression mechanism 170.

The connector body assembly 210 includes an upper body member 220, a lower body member 230, and an intermediate body member 240 generally corresponding to the body members 120, 130, and 140, respectively. The upper body member 220 includes a support portion 222 and a jaw portion 224 extending laterally from the support portion 222 with respect to the connector axis G-G. The jaw portion 224 is configured in the same manner as the jaw portion 124. A bore 222B is defined in the support portion 222.

The lower body member 230 includes a support portion 232 and a jaw portion 234 extending laterally from the support portion 232 with respect to the connector axis G-G. The support portion 232 includes a rail or coupling portion 233, a lower bore 232A, a reduced diameter upper bore 232B, and a shoulder 232C. The jaw portion 234 is configured in the same manner as the jaw portion 134.

The intermediate body member 240 includes a support portion 242 and a double sided jaw portion 144. A through bore 242A is defined in the support portion 242. The jaw portion 244 is configured in the same manner as the jaw portion 144.

The rail portion 233 of the lower body member 230 is received in the bore 222B of the upper body member 220 to permit the lower body member 230 to telescopingly slide in and out of the upper body member 220 along a slide axis B-B. The rail portion 233 and the bore 222B have complementary shapes (hexagonal) to prevent relative rotation. In this way, the spacing distance D1 between the cable seats 224A, 234A can be varied. The intermediate body member 240 is slideably mounted on the upper body member 220 (which extends through the bore 242A) to permit the intermediate body member 240 to slide up and down the upper body member 220 along the slide axis B-B.

The compression mechanism 270 includes a bolt 272, a cooperating anchor nut 274, and a torque control member in the form of a shear cap 276. The bolt 272 includes a threaded shank 272A and a head 272B. The shear cap 276 includes a shear head 276A, a base portion 276B, a shear or breakaway section 276C coupling the portions 276A and 276B, a socket 276D defined in the base portion 276B, and a washer 276E. The bolt 272 extends through the bores 122A, 122B and is axially constrained by bolt head 272B and the shoulder 122C. The nut 274 is threaded on the shank 272A and axially constrained by the shoulder 132C. The nut 274 is also rotationally fixed by the upper bore 132B, which has a noncircular shape that is complementary to the shape (e.g., hex-shaped) of the nut 274. The shear cap 274 is mounted on the bolt 272 such that the head 272B is seated in the socket 276D. The head 272B and the socket 276D have complementary, noncircular shapes (e.g., hex-shaped) so that torque applied to the shear cap 276 is transmitted to the bolt 272.

In use, the head 276A is engaged by a driver and forcibly rotated thereby. The bolt 272 is thereby rotated relative to the axially and rotationally constrained nut 274. This causes the nut 274 to translate up the shank 272A, which slides or translated the body portions 220 and 230 together (in respective directions M1 and M2) along the slide axis B-B. The shear head 276A will shear off of the base 276B at the breakaway section 276C when subjected to a prescribed torque.

Figure 11:
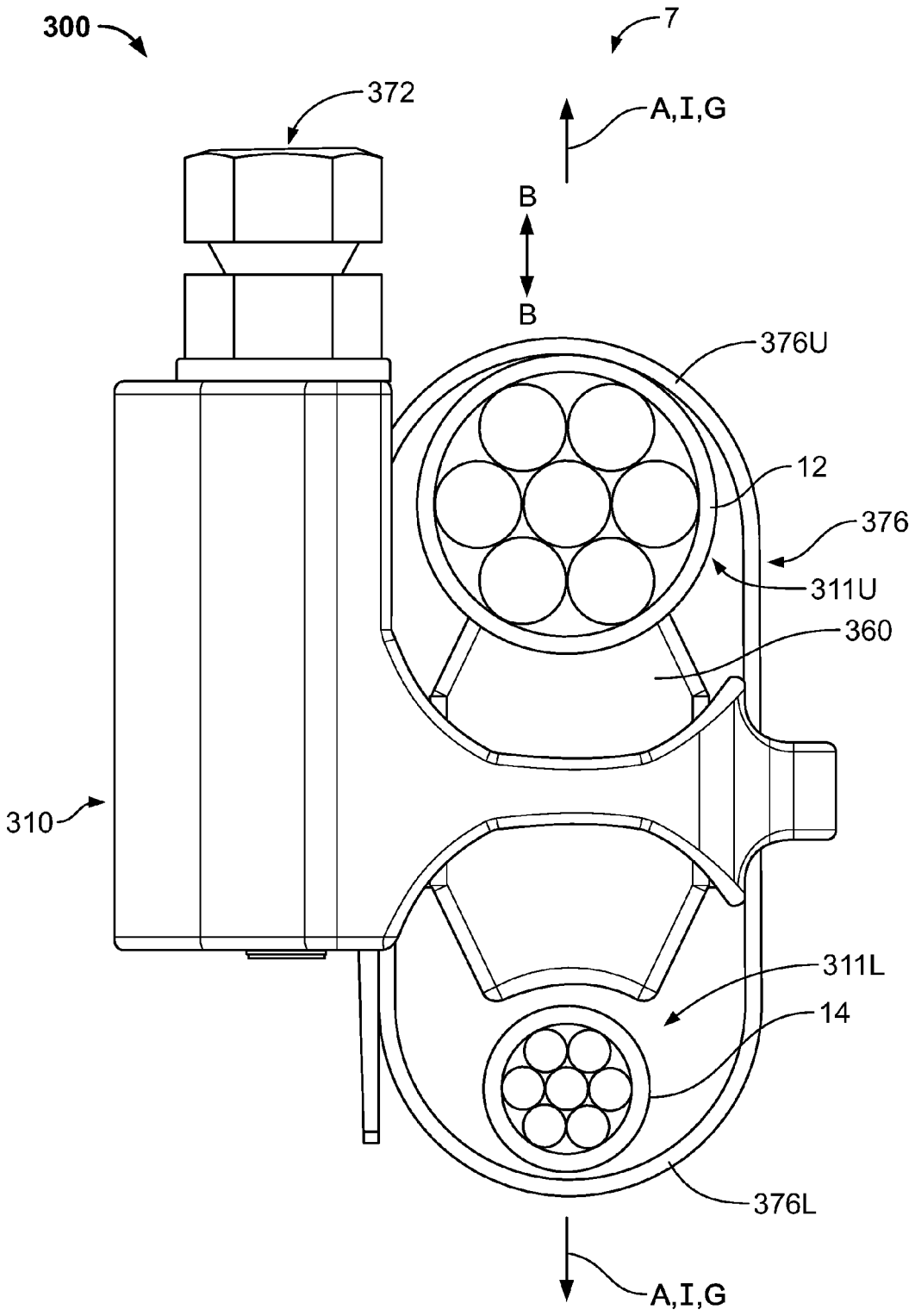
FIG. 11 is an end view of the connector of FIG. 8 and a pair of cables to be connected before a compression mechanism of the connector is tightened onto the cables.
Figure 12:
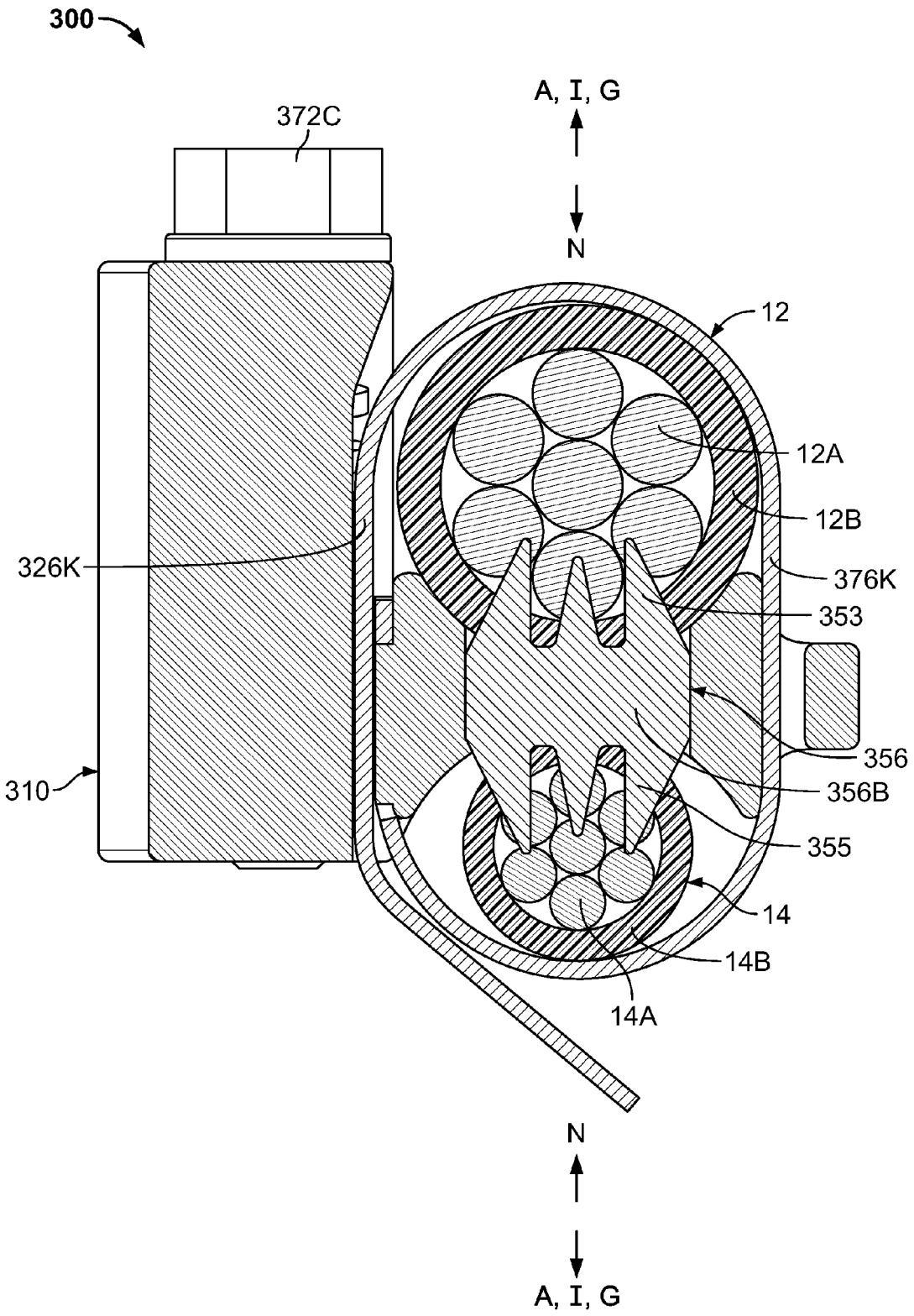
FIG. 12 is a cross-sectional view of a connection of the connector and cables of FIG. 11.

With reference to FIGS. 8-12, a multi-tap or multi-cable insulation piercing electrical connector 300 according to further embodiments of the present invention is shown therein connecting cables 12, 14 to form a connection 7 (FIG. 12). The connector 300 has a connection axis G-G and includes a connector body 310, a pair of electrically conductive blade members 356 (constructed as described above for the blade members 156), seals 360, a cable end cap 362, and a compression mechanism 370.

The connector body 310 includes a support portion 312 and an integral jaw portion 314. A pair of axially opposed cable seats 314A, 314D, a pair of blade slots or seats 314B (extending axially fully through the jaw portion 314), and seal seats 314C are defined in the jaw portion 314. The blade members 356 are affixed in the blade slots 314B such that their insulation piercing features 355 project in opposed axial directions from the cable seats 314A, 314D. A compression strap guide slot 316 is provided on the outer end of the jaw portion 314. A bore 312A, a flange 312B, a shoulder 312C, a strap entry slot 312D, and a strap exit slot 312E are provided in the support portion 312. The connector body 310 may be formed of the materials discussed above with regard the connector body member 110.

The compression mechanism 370 includes a bolt 372 and a flexible compression wrapping tape or strap 376. The bolt 372 has a shank 372A (having a drive thread 372B), a primary head 372C and a shear head 372D (connected to the head 372C by a breakaway or shear section 372E). The bolt 372 is rotatably secured in the bore 312A by the head 372C (which is constrained by the shoulder 312C) and a clip 374 (which is constrained by the flange 312B).

The compression strap 376 has a fixed end 376A anchored to the support body 312, and a free end 376B. Drive fillets or slots 376C are defined in the strap 376. The strap 376 is looped under the cable seat 314D, through the guide slot 316 and over the cable seat 314A. Before or during assembly, the end 376B is engaged with the thread 372B to anchor the free end of the strap and close the loop over the cable seat 314A.

The bolt 372 and the strap 376 may be formed of any suitable materials. The bolt 376 may be formed of materials as discussed above with regard to the bolt 172. According to some embodiments, the strap 376 is formed of a flexible metal. Other suitable materials for the strap 376 may include plastic, mesh metal, textile, wires or a combination of components (e.g., metal covered with rubber). According to some embodiments, the strap 376 is monolithic. In some embodiments, the strap 376 is a web or tape having a width substantially greater than its thickness. In other embodiments, the strap 376 may be a rope, cord, cable or wire having substantially the same width and thickness.

The connector 300 may be used as follows to form an electrical and mechanical connection between two insulated cables 12, 14. With the strap 376 sufficiently loosened, the cables 12 and 14 are seated in the cable seats 314A and 314D. The strap free end 376A may be engaged with the bolt 372 before or after seating one or both of the cables 12, 14. For example, if an end of the cable 12 is not readily accessible, the cable 12 can be laterally inserted or laid in the cable seat 314A with the strap 376 open (i.e., the strap end 376B unsecured). With the free end 376A secured, the strap 376 has an upper loop section 376U defining (with the cable seat 314A) an upper cable receiving slot 311U, and a lower loop section 376L defining (with the cable seat 314D) a lower cable receiving-slot 311L (FIG. 11).

After the cables 12, 14 are positioned and the strap 376 is engaged with the bolt 372, the bolt 372 is rotatively driven to pull the strap 376 tight about the cables 12, 14. According to some embodiments, the strap 376 is tightened until a prescribed torque sufficient to break off the shear head 372D is applied, whereupon the shear head 372D will shear off from the bolt 372. As the strap 376 is tightened, its effective length (i.e., the length between the anchor points on the support portion 312) is reduced and cables are driven axially inwardly and convergingly toward the jaw portion 314.

As a result, the insulation piercing features 353, 355 of the blade members 356 are driven into the cable 12, and the insulation piercing features 355 of the blade members 356 are driven into the cable 14. More particularly, the teeth of the features 353 are forced through the insulation layer 12B and into mechanical and electrical contact with the conductor 12A, and the teeth of the features 353 are forced through the insulation layer 14B and into mechanical and electrical contact with the conductor 14A. The teeth embed in the insulation layers 12B, 14B and make electrical and mechanical contact or engagement with the conductors 12A, 12B. In the foregoing manner, the connector assembly 100 is operatively connected to the cables 12, 14 and the conductors 12A, 14A are electrically connected to one another without stripping the insulation layers 12B, 14B.

According to some embodiments, the teeth of the features 353, 355 embed in the conductors 12A, 14A. According to some embodiments, the teeth embed into the conductors 12A, 14A a distance of at least about 0.5 mm.

The seal members 260 engage and form an environmental seal about the sections of the cables 12, 14 perforated by the teeth.

In the foregoing manner, the connection 7 (FIG. 12) can be formed. The blade members 356 provide electrical continuity (i.e., a path for electrical current flow) between the conductors 12A, 14A through the connecting portions 356B. The connector 300 mechanically secures the cables 12, 14 relative to one another. Moreover, the connector 300 provides environmental protection for the locations in the insulation layers 12B, 14B pierced by the blade members 356.

The mechanical configuration of the connector 300 enables the conductors 12A, 14A to be electrically connected with a current flow path directly through a blade member 356 having a relatively short bridging or connecting portion 356A, thereby reducing the conduction path between the conductors 12A, 14A. The connector 300 can thereby provide reduced electrical resistance.

With reference to FIGS. 12, it can be seen that the installed cables 12, 14 are arranged such that they are aligned with one another along a cable alignment axis I-I, which may be transverse (e.g., perpendicular) to the cable axes E-E, F-F. When the connector 300 is closed on the cables 12, 14 as described above, the compression strap 376 applies a compressive clamping load N along a clamping load axis A-A substantially parallel to the clamping displacement axis B-B. The cable alignment axis I-I is parallel to, and in some embodiments substantially coincident (i.e., coaxial) with, the clamping load axis A-A and the connection axis G-G. That is, the clamping load N is applied through a clamping load axis A-A that extends through both connected cables 12, 14. By stacking the cables 12, 14 in series along the load axis A-A in this manner, the total clamping load required is reduced. As a result, less torque must be applied to the compression mechanism to effect the desired clamping load on each cable.

The configuration of the compression mechanism 370 can further reduce the torque required to achieve a desired clamping load by providing enhanced mechanical advantage. More particularly, forced rotation of the bolt 372 induces tension in the strap 376, which in turn forcibly displaces the cables 12, 14, permitting the lengths of the side strap sections 376J, 376K (FIG. 12) to shorten as the strap 376 slides over the cables 12, 14. The tension load is therefore shared between the two side strap sections 376J, 376K and the moving cable or cables 12, 14 function substantially as floating pulleys. As a result, the torque (effort) that must be applied to the bolt 372 to generate a given amount of tension in the strap 376 (and a corresponding amount of compression load on the cables 12, 14) is reduced by approximately one half.

The compression strap 376 automatically adapts to the sizes of the cables 12, 14 as the strap 376 is taken up by the bolt 372. The connector 300 can thereby accommodate a variety of cable size combinations, including cables of the same size (e.g., for splicing connections) and cables of different sizes (e.g., for tapping connections). Moreover, the flexible strap 376 can conform to the cables 12, 14 to more evenly distribute the clamping forces.

Figure 16:
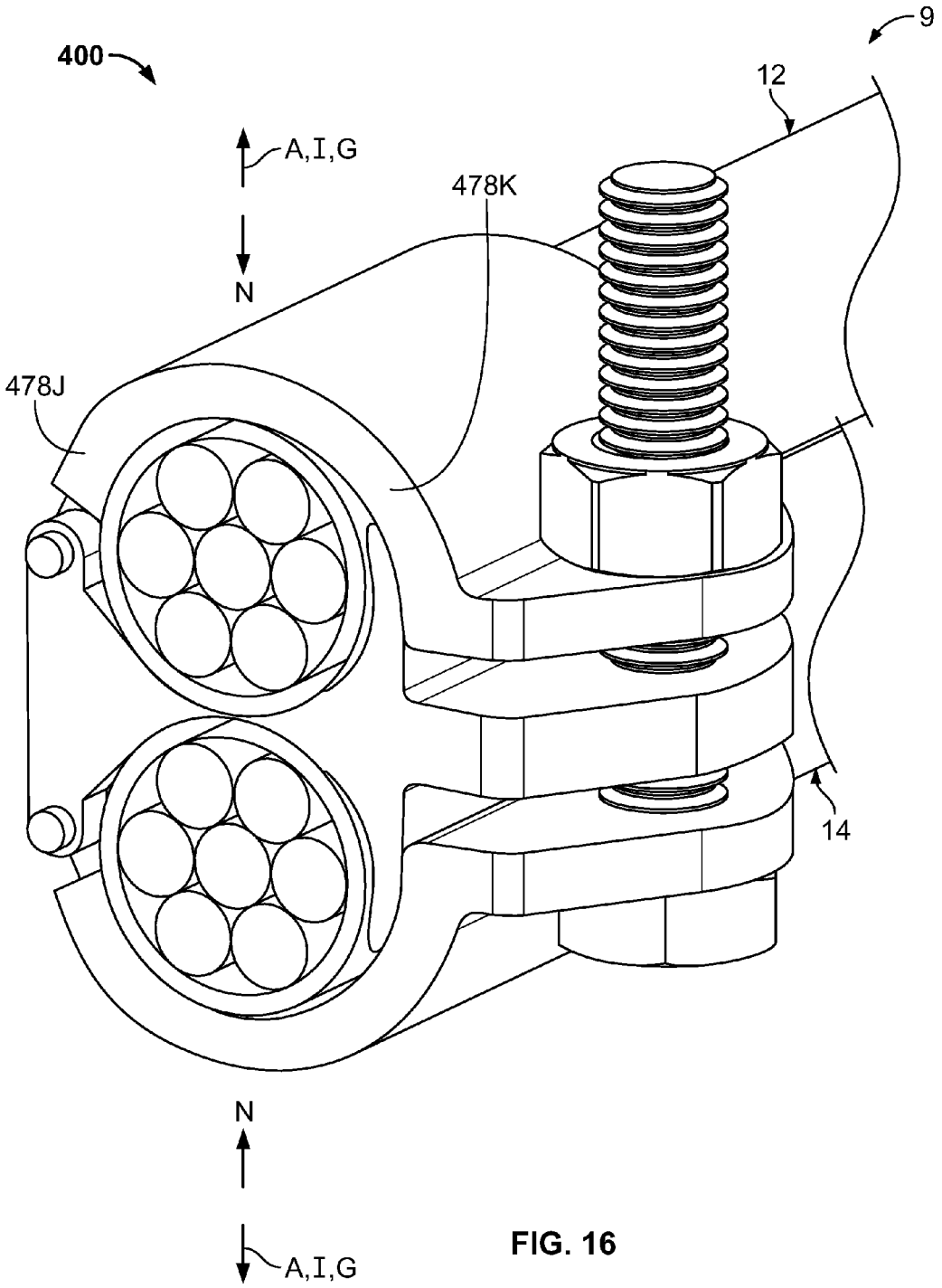
FIG. 16 is a perspective view of a connection of the connector and cables of FIG. 15.

With reference to FIGS. 13-17, a multi-tap or multi-cable insulation piercing electrical connector 400 according to further embodiments of the present invention is shown therein connecting cables 12, 14 to form a connection 9 (FIG. 16). The connector 400 has a connector axis G-G and includes a connector body 410, a pair of electrically conductive blade members 456 (FIG. 14; constructed as described above for the blade members 156), seals 460, and a compression mechanism 470.

The connector body 410 includes a jaw portion 414, integral inner lateral side walls 416, integral outer side walls 417, integral hinge features 418, and a support portion or tab 419. A pair of axially opposed cable seats 414A, 414D, a pair of blade slots or seats 414B (extending axially fully through the jaw portion 414), and seal seats 414C are defined in the jaw portion 414. The blade members 456 are affixed in the blade slots 414B such that their insulation piercing features 455 project in opposed axial directions from the cable seats 414A, 414D. The connector body 410 may be formed of the materials discussed above with regard the connector body member 110.

The compression mechanism 470 includes a bolt 472, a shear nut 476, and opposed clamp bodies 478. Hinge pins 477 pivotably couple the clamp bodies 478 to the hinge features 418.

Figure 13:
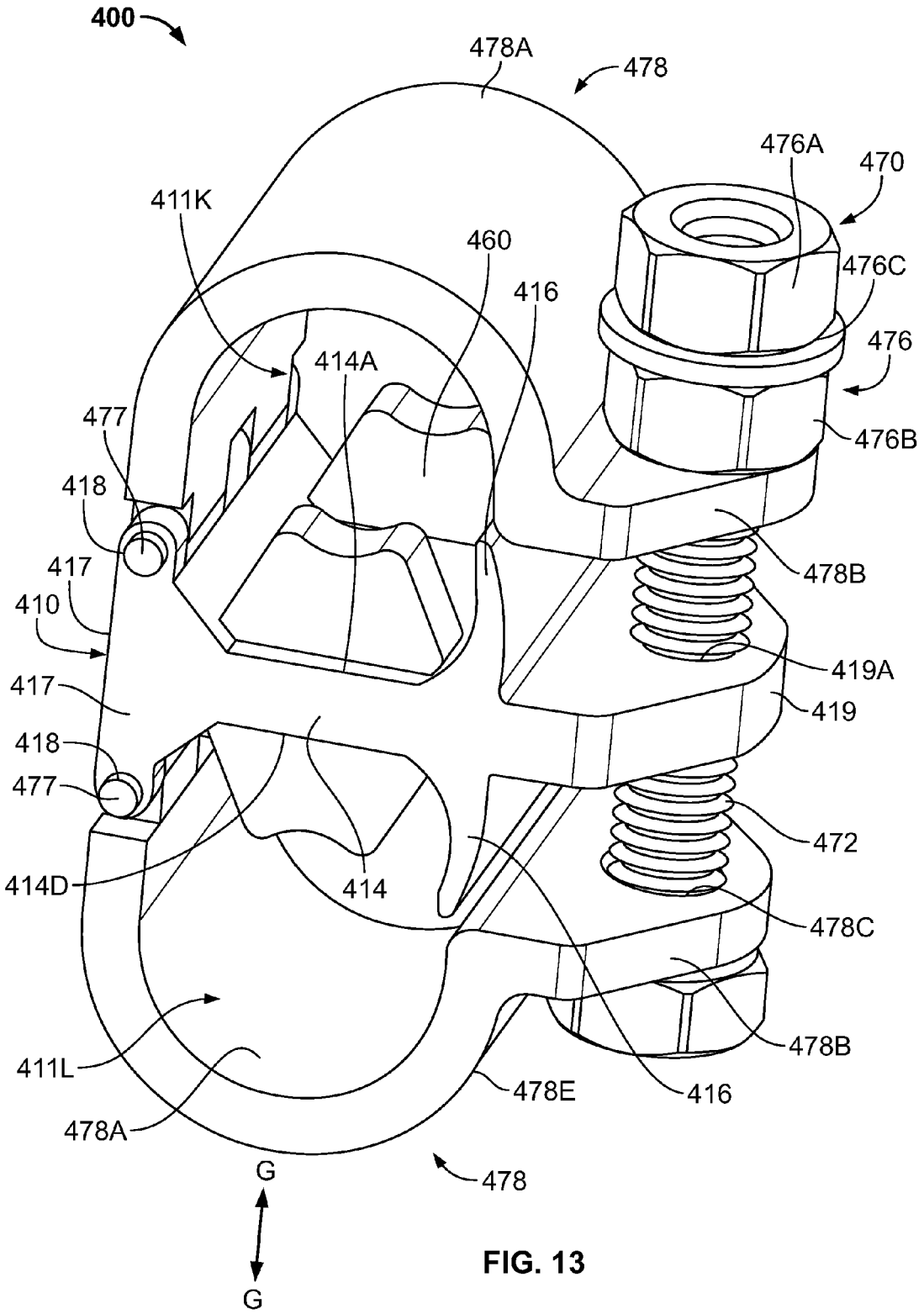
FIG. 13 is a perspective view of a connector according to further embodiments of the present invention in an open position.
Figure 14:
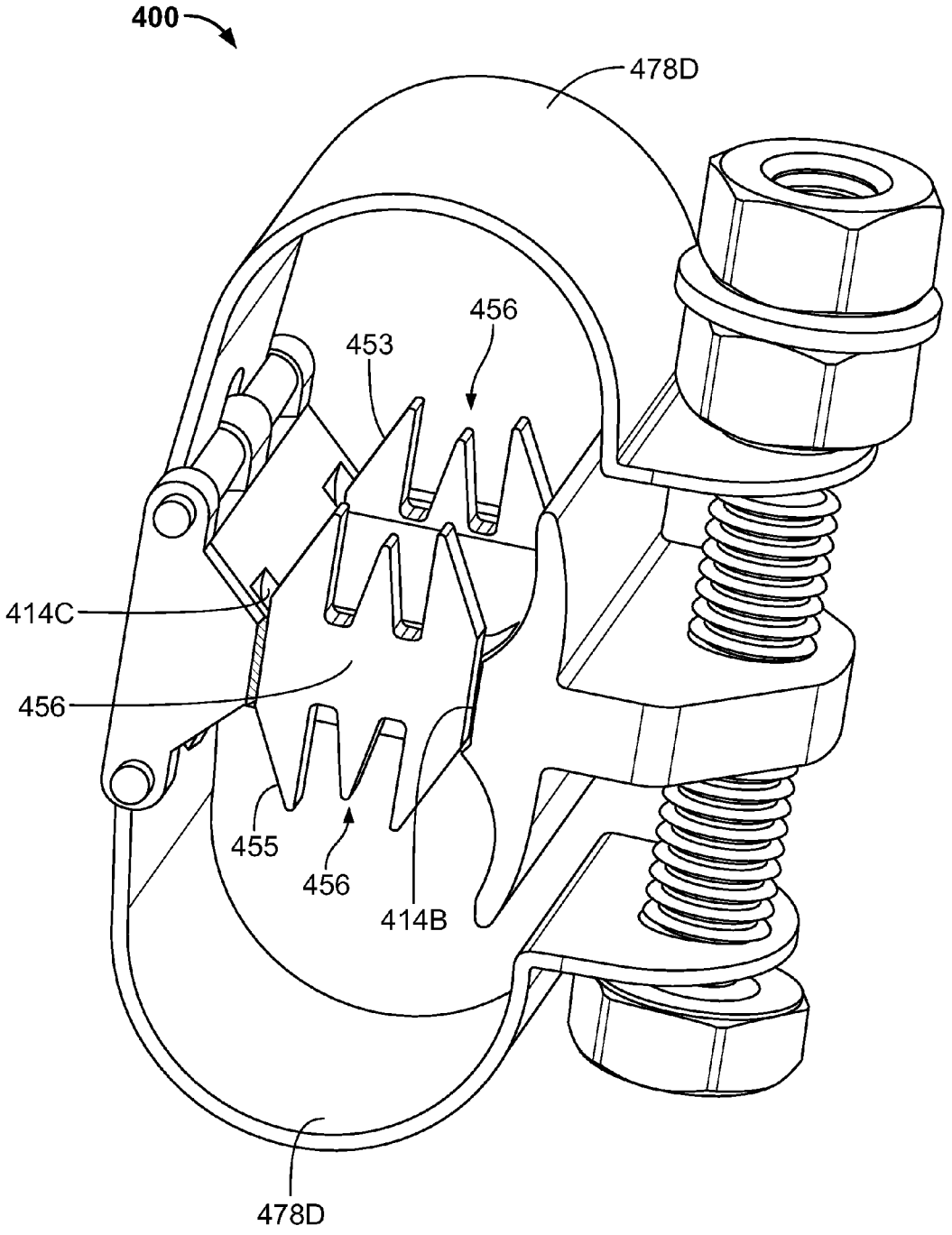
FIG. 14 is a fragmentary, perspective view of the connector of FIG. 13.
Figure 15:
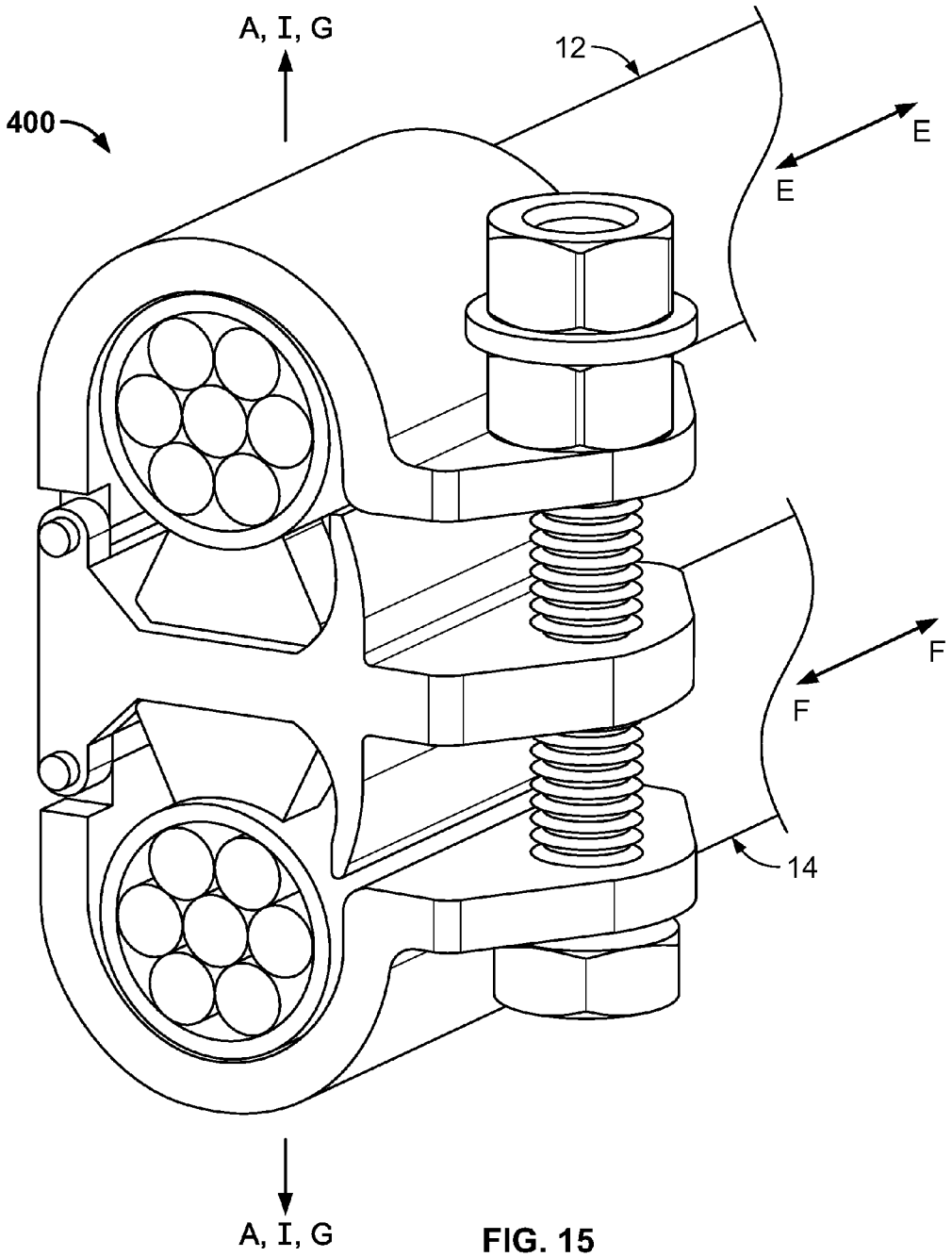
FIG. 15 is a perspective view of the connector of FIG. 13 and a pair of cables to be connected before a compression mechanism of the connector is tightened onto the cables.

The clamp bodies 478 each include a cable engagement portion 478A and an anchor tab 478B (including a bore 478C). According to some embodiments, the clamp bodies 478 are formed of a flexible material such as a flexible metal. In some embodiments, the clamp bodies 478 are formed of relatively thin, flexible metal straps. In some embodiments and as shown, each clamp body 478 includes a metal substrate 478D (FIG. 14; in some embodiments, a flexible metal member, such as a strap or tape) covered by a polymeric (e.g., rubber) cover 478E (FIG. 13).

The bolt 472 extends through the bores 478C and a bore 419A in the support tab 419 and threadedly engages the shear nut 476. The shear nut 476 includes a shear head 476A and a threaded base portion 476B joined by an integral shear section 476C. The rigid connector body 410 maintains the bolt 472 in alignment with the connection axis G-G.

The connector 400 may be used as follows to form an electrical and mechanical connection between two insulated cables 12, 14. With the clamp bodies 478 sufficiently loosened, the cables 12 and 14 are seated in the cable seats 414A and 414D. The anchor tabs 478B may be engaged with the bolt 472 before or after seating one or both of the cables 12, 14. For example, if an end of the cable 12 is not readily accessible, the cable 12 can be laterally inserted or laid in the cable seat 414A with the upper clamp body 478 open (i.e., the anchor tab 478B unsecured). When closed, the upper and lower clamp bodies 478 define (with the cable seats 414A and 414D) respective upper and lower cable receiving slots 411U and 411L (FIG. 13).

After the cables 12, 14 are positioned and the anchor tabs 478B engaged with the bolt 472, the bolt 472 and/or the shear nut 476 is/are rotatively driven to pull the clamp bodies 478 tight about the cables 12, 14 as shown in FIG. 16. According to some embodiments, the clamp bodies 478 are tightened until a prescribed torque sufficient to break off the shear head 476D is applied, whereupon the shear head 476D will shear off from the base portion 476B. As the clamp bodies 478 are tightened, the cables 12, 14 are driven axially inwardly and convergingly toward the jaw portion 414. The clamp bodies 478 may collapse, bend or deform to conform to the cables 12, 14. The clamp bodies 478 are guided by the side walls 416.

As a result, the insulation piercing features 453 (FIG. 14) of the blade members 456 are driven into the cable 12, and the insulation piercing features 455 of the blade members 456 are driven into the cable 14 as described above to force the teeth thereof through the insulation layers 12B, 14B and into mechanical and electrical, embedded contact with the conductors 12A, 14A. In the foregoing manner, the connector 400 is operatively connected to the cables 12, 14 and the conductors 12A, 14A are electrically connected to one another without stripping the insulation layers 12B, 14B.

According to some embodiments, the teeth embed in the conductors 12A, 14A. According to some embodiments, the teeth embed into the conductors 12A, 14A a distance of at least about 0.5 mm.

The seal members 460 engage and form an environmental seal about the sections of the cables 12, 14 perforated by the teeth.

It will be appreciated that, as in the above-described embodiments, the mechanical configuration of the connector 400 enables the conductors 12A, 14A to be electrically connected with a current flow path directly through a blade member 456 having a relatively short bridging or connecting portion 456A, thereby reducing the conduction path between the conductors 12A, 14A.

Figure 17:
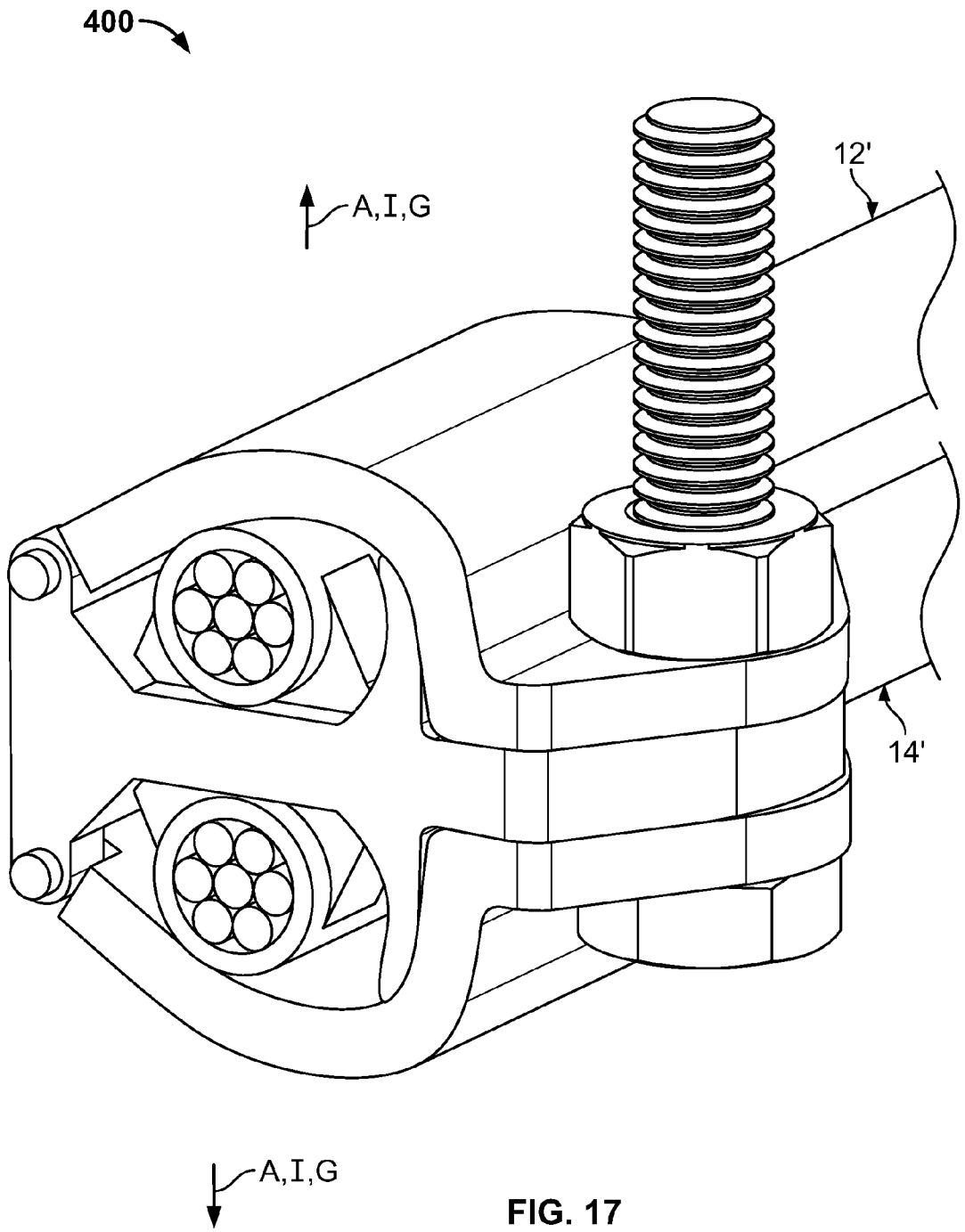
FIG. 17 is a perspective view of a connection of the connector of FIG. 13 and a pair of smaller diameter cables.

With reference to FIGS. 16 and 17, it can be seen that the installed cables 12, 14 are also arranged such that they are aligned with one another along a cable alignment axis I-I, which may be transverse (e.g., perpendicular) to the cable axes E-E, F-F. When the connector 400 is closed on the cables 12, 14 as described above, the clamp bodies 478 apply compressive clamping loads N along a clamping load axis A-A substantially parallel to the clamping displacement axis B-B and the connection axis G-G. The cable alignment axis I-I is parallel to, and in some embodiments substantially coincident (i.e., coaxial) with, the clamping load axis A-A. That is, the clamping load N is applied through a clamping load axis A-A that extends through both connected cables 12, 14. By stacking the cables 12, 14 in series along the load axis A-A in this manner, the total clamping load required is reduced, thereby reducing the required installation torque.

The configuration of the compression mechanism 470 can further reduce the torque required to achieve a desired clamping load by providing enhanced mechanical advantage in the same or similar manner as the compression mechanism 270. More particularly, the tension load induced in each clamp body 478 is shared between the opposed side sections 478J and 478K (FIG. 16) and the cables 12, 14 are forcibly displaced. As a result, the torque (effort) that must be applied to the bolt 472 or shear nut 476 to generate a given amount of tension in the clamp body 478 (and a corresponding amount of compression load on the cables 12, 14) is reduced.

The clamp bodies 478 automatically adapt to the sizes of the cables 12, 14 as the clamp bodies 478 are pulled tight. The connector 400 can thereby accommodate a variety of cable size combinations, including cables of the same size (e.g., for splicing connections) and cables of different sizes (e.g., for tapping connections). Also, the deformable clamp bodies 478 can conform to the cables 12, 14 to more evenly distribute the clamping forces.

With reference to FIG. 17, the connector 400 is shown therein installed a different combination of (smaller) cables 12', 14'.

Figure 18:
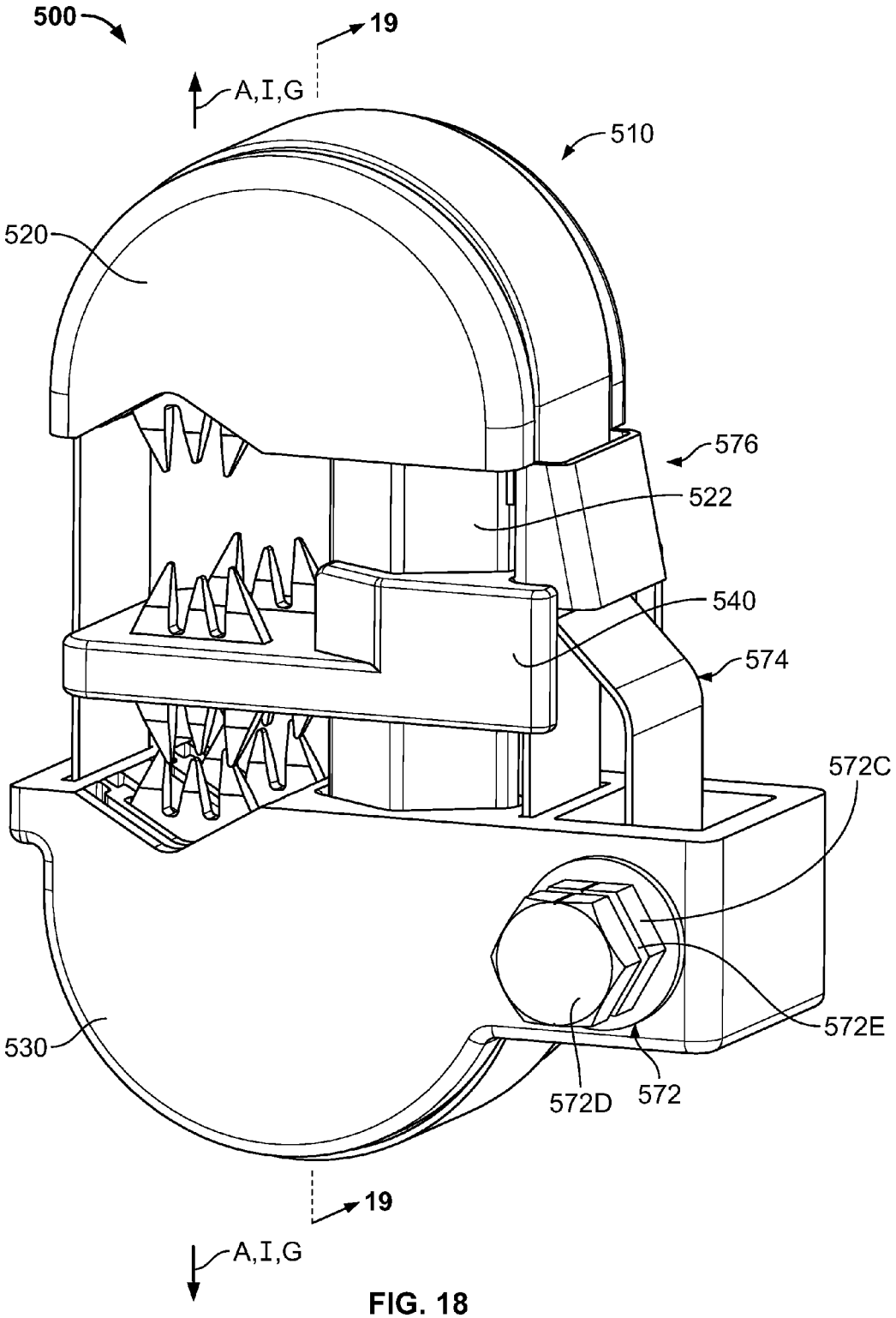
FIG. 18 is a perspective view of a connector according to further embodiments of the present invention in an open position.
Figure 19:
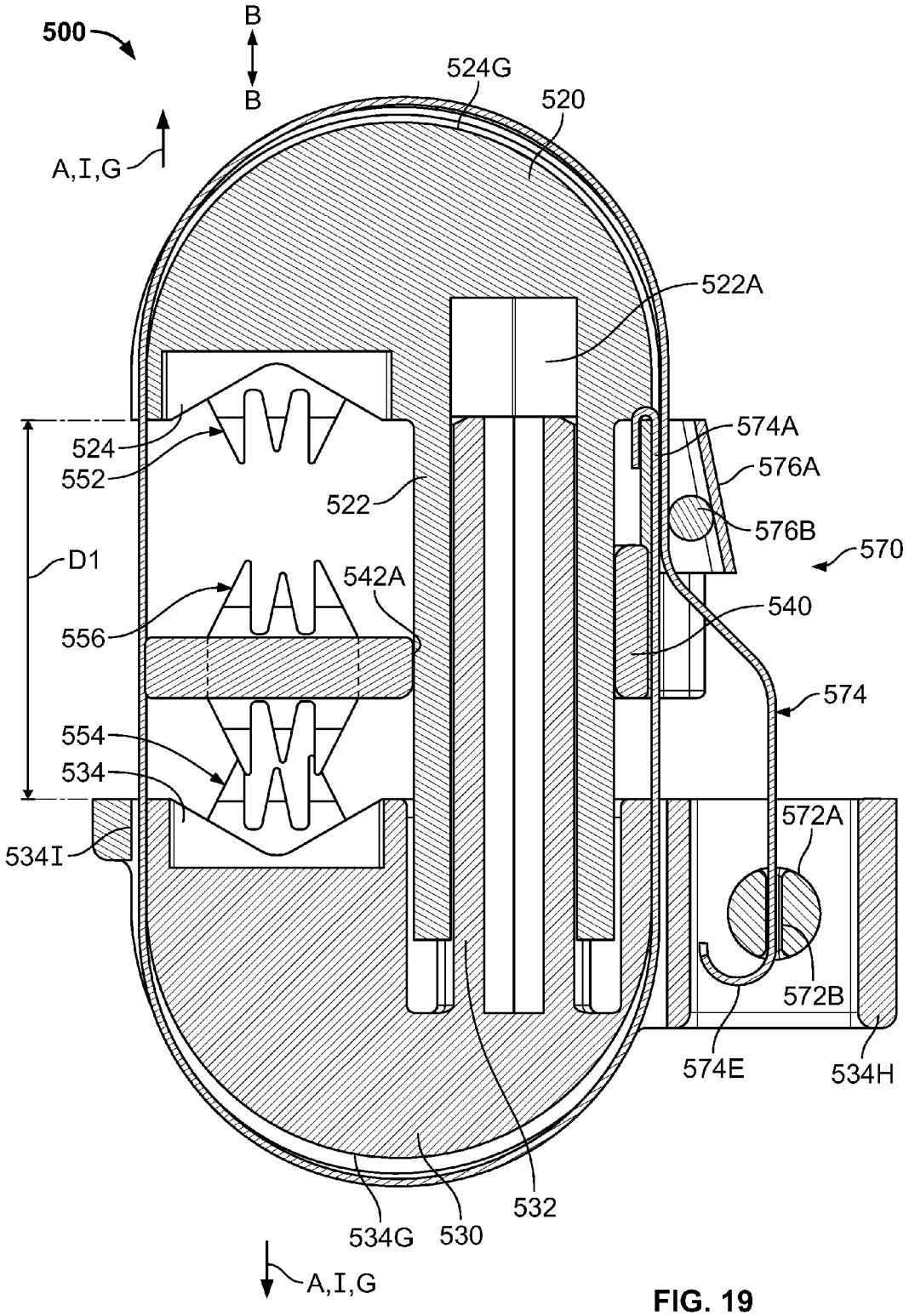
FIG. 19 is a cross-sectional view of a connection of the connector and cables of FIG. 18 taken along the line 19-19 of FIG. 18.

With reference to FIGS. 18 and 19, a multi-tap or multi-cable insulation piercing electrical connector 500 according to further embodiments of the present invention is shown therein. The connector 500 is constructed and can be used in generally the same manner as the connector 100 except that the connector body assembly 510 and the compression mechanism 570 of the connector 200 are configured differently than the connector body assembly 110 and the compression mechanism 170.

The connector body assembly 510 includes an upper body member 520, a lower body member 530, and an intermediate body member 540 generally corresponding to the body members 120, 130, and 140, respectively. The upper body member 520 includes a coupling or rail portion 522 and a jaw portion 524 extending laterally from the rail portion 522 with respect to the connector axis G-G. A bore 522A is defined in the rail portion 522. The jaw portion 524 is configured in the same manner as the jaw portion 124 except that the jaw portion 524 includes a strap groove 524G.

The lower body member 530 includes a coupling or rail portion 532, a drive support portion 534H, and a jaw portion 534 extending laterally from the rail portion 532 with respect to the connector axis G-G. The jaw portion 534 is configured in the same manner as the jaw portion 134 except that the jaw portion 524 includes a strap groove 534G and a strap guide slot 534I.

The intermediate body member 540 includes a support portion 542 and a double sided jaw portion 544. A through bore 542A is defined in the support portion 542. The jaw portion 544 is configured in the same manner as the jaw portion 144.

The rail portion 532 of the lower body member 530 is received in the bore 522A of the upper body member 520 to permit the lower body member 530 to telescopingly slide in and out of the upper body member 520 along a slide axis B-B. The rail portion 532 and the bore 522A have complementary shapes (hexagonal) to prevent relative rotation. In this way, the spacing distance D1 between the cable seats 524A, 534A can be varied. The intermediate body member 540 is slideably mounted on the upper body member 520 (which extends through the bore 542A) to permit the intermediate body member 540 to slide up and down the upper body member 520 along the slide axis B-B.

The compression mechanism 570 includes a drive bolt 572, a compression strap 574 and a locking mechanism 576. The drive bolt 572 includes a shank 572A extending laterally across the drive support portion 534H and having a slot 572B therein. The bolt 572 further includes a base head 572C and a shear head 572D joined by an integral shear section 572E.

The compression strap 574 extends from an anchored first end 574A, through the groove 534G around the jaw portion 534, through the strap guide slot 534H, up the front of the connector 500 to the upper jaw portion 524, through the groove 524G around the jaw portion 524, through the locking mechanism 576, and through the slot 572B. The compression strap may be constructed of bendable or flexible material as described above with regard to the compression strap 376. Likewise, the strap 574 may be a web or tape having a width substantially greater than its thickness. In other embodiments, the strap 574 may be a rope, cord, cable or wire having substantially the same width and thickness.

The locking mechanism 576 includes a locking head 576A and a roller member 576B (e.g., a roller ball, bearing or pin) confined in the locking head 576A. The locking mechanism may be, for example, a ball lock cable tie. The locking mechanism 576 is configured such that when tension is applied to the strap 574, the strap 574 will wedge the roller member 576B against the strap 574 in the locking head 576A, thereby locking the strap 574 in place.

The connector 500 may be used as follows to form an electrical and mechanical connection between two insulated cables (e.g., cables 12 and 14). With the compression strap 574 sufficiently loosened and the jaws 524, 534 spread apart, the cables are seated in the cable seats 514A and 514D. The strap 574 may be engaged with the locking head 576A before or after seating one or both of the cables. For example, if an end of a cable is not readily accessible, the cable can be inserted or laid in the cable seat 514A laterally with the strap 574 pulled out of the way.

After the cables are positioned and the end 574E of the strap 574 is routed through the locking head 576A and the bolt slot 572B, the bolt 572 is forcibly rotated wind the strap 574 about the bolt 572 and thereby pull strap 574 tight about the jaw portions 524, 534 and the cables 12, 14. According to some embodiments, the strap 574 is tightened until a prescribed torque sufficient to break off the shear head 572D is applied, whereupon the shear head 572D will shear off from the base portion 572C. As the strap 574 is tightened, the cables are driven axially inwardly and convergingly toward the jaw portion 542. The strap 574 will slide over and compressively load the bearing surfaces in the strap grooves 524G, 534G.

The insulation piercing features of the blade members 552, 554, 556 are thereby driven into the cables into mechanical and electrical, embedded contact with the cable conductors as described above with regard to the connector 100.

Seal members (not shown) corresponding to the seal members 160 may be provided to engage and form an environmental seal about the sections of the cables perforated by the teeth.

It will be appreciated that, as in the above-described embodiments, the mechanical configuration of the connector 500 enables the cable conductors to be electrically connected with a current flow path directly through a blade member 556 having a relatively short bridging or connecting portion, thereby reducing the conduction path between the cable conductors. Also, the provision of the supplemental blade members 552, 554 can provide the low electrical resistance flow path benefits as described above with regard to the supplemental blade members 152, 154. Moreover, it will be appreciated that the connector 500 also provides a clamping load axis A-A parallel to, and in some embodiments substantially coincident (i.e., coaxial) with the cable alignment axis I-I and the above-mentioned benefits attendant thereto. The configuration of the compression mechanism 570 can further reduce the torque required to achieve a desired clamping load by providing enhanced mechanical advantage in the same or similar manner as the compression mechanism 270.

Figure 20:
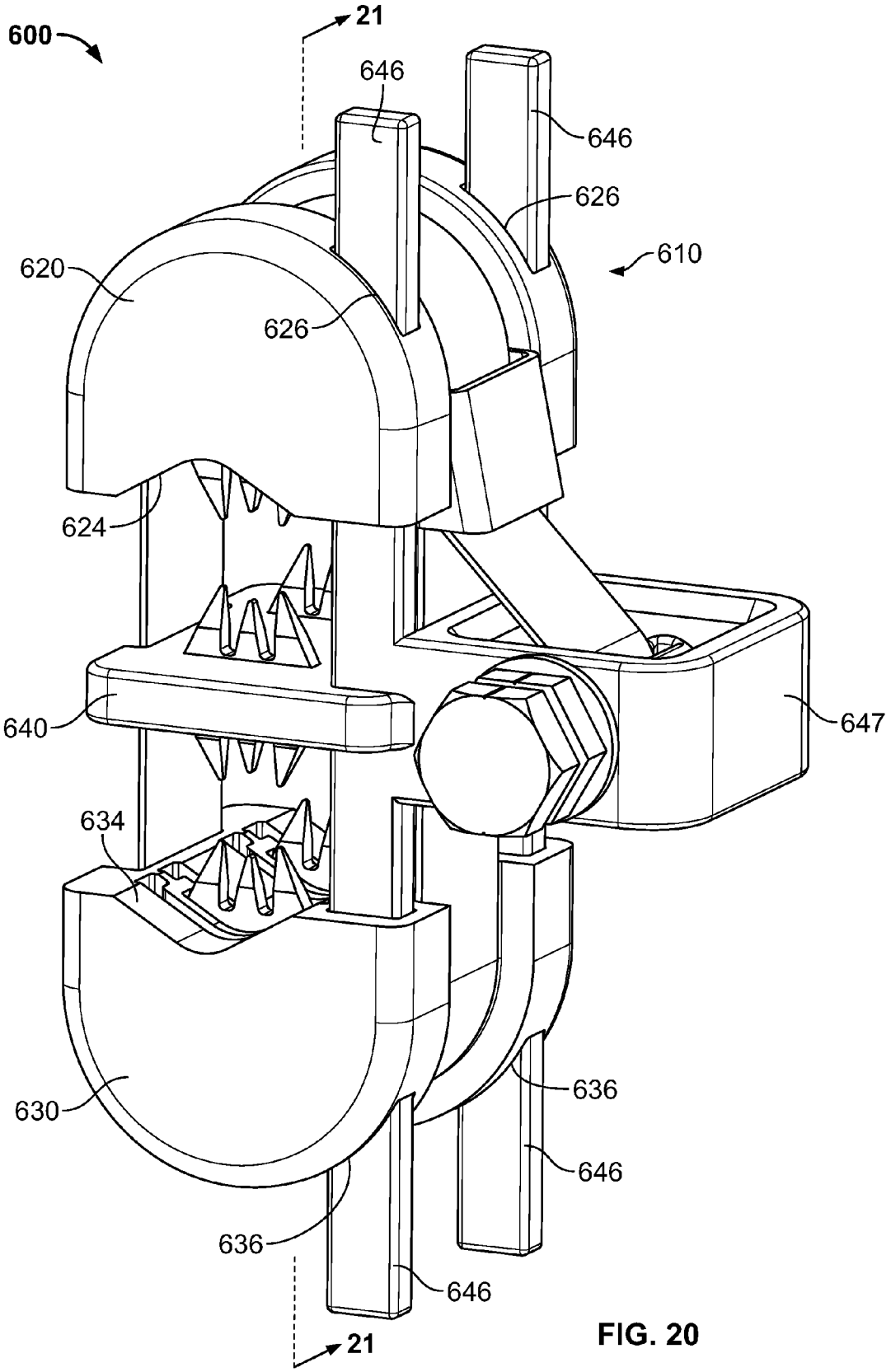
FIG. 20 is a perspective view of a connector according to further embodiments of the present invention in an open position.
Figure 21:
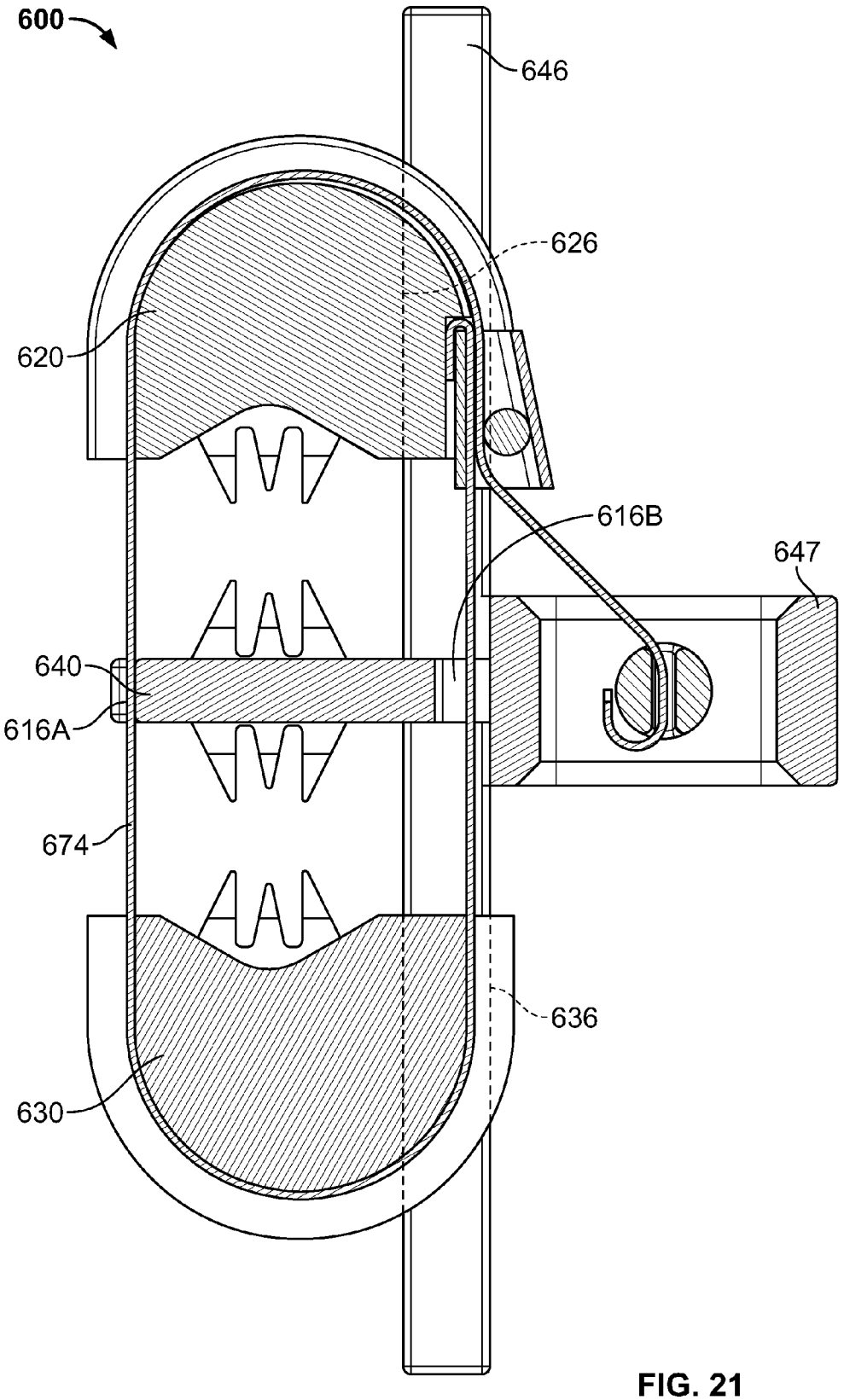
FIG. 21 is a cross-sectional view of a connection of the connector and cables of FIG. 20 taken along the line 21-21 of FIG. 20.

With reference to FIGS. 20 and 21, a multi-tap or multi-cable insulation piercing electrical connector 600 according to further embodiments of the present invention is shown therein. The connector 600 is constructed and can be used in generally the same manner as the connector 500 except that the connector body assembly 610 of the connector 600 is configured differently than the connector body assembly 510. More particularly, the intermediate body member 640 of the connector body assembly 610 includes guide legs 646 that extend through guide slots 626 and 636 of the upper body member 620 and the lower body member 630. The body members 620, 630 are thereby slideably and telescopingly mounted on the legs 646 to permit the jaw portions 624 and 634 to be converged when the compression mechanism 670 is operated as discussed above. Strap guide slots 616A and 616B (FIG. 21) are provided to locate the compression strap 674. The configuration of the connector body assembly 610 may be advantageous in that the drive support portion 647 is located axially (and, in some embodiments, centrally) between the jaw portions 624, 634.

Figure 22:
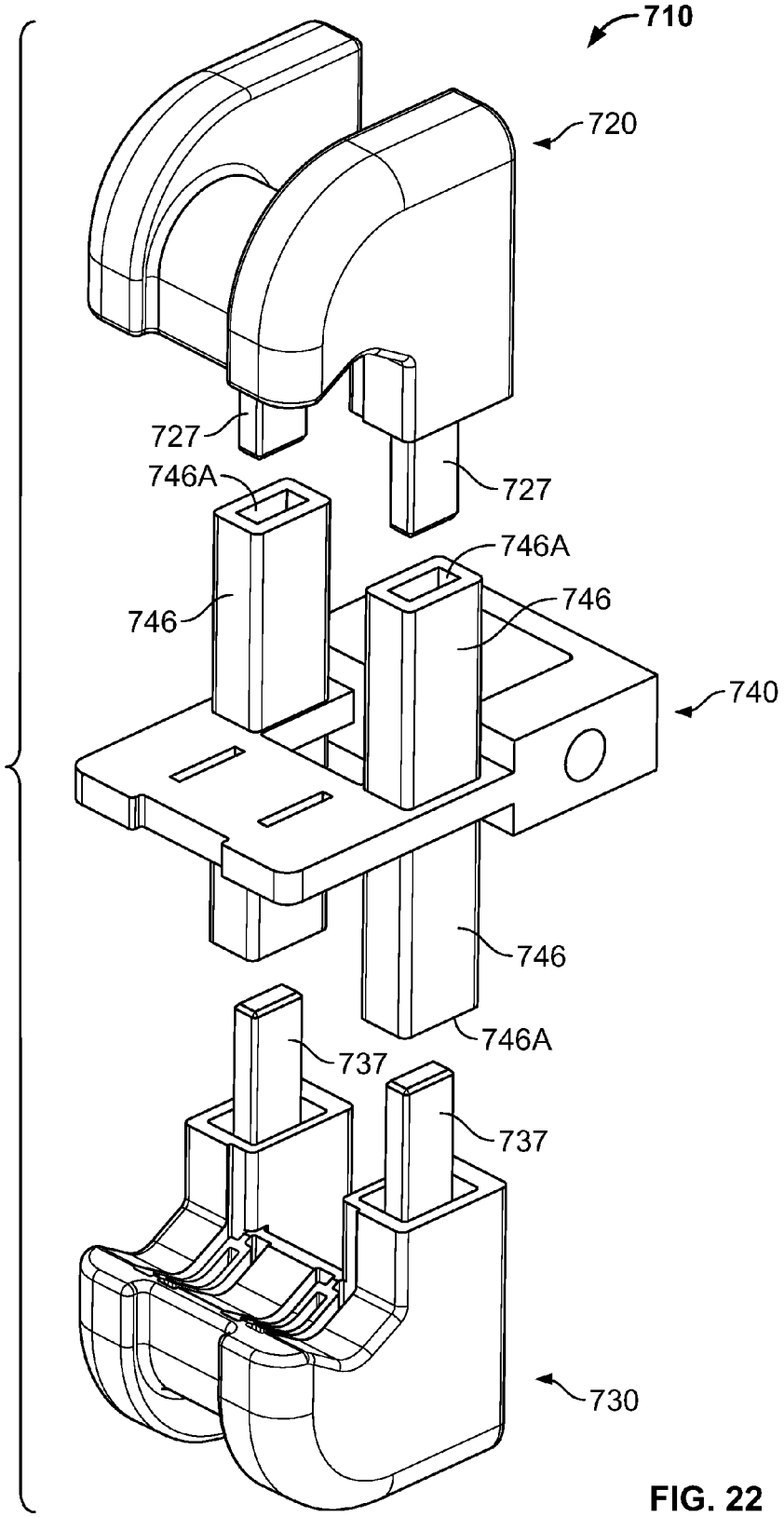
FIG. 22 is an exploded, perspective view of a connector body assembly according to further embodiments of the present invention.

With reference to FIG. 22, an alternative connector body assembly 710 that may be used in a connector otherwise configured and used substantially the same as the connector 600. The connector body assembly 710 includes an intermediate body member 740 having guide legs 746 provided with guide bores 746A. The upper body member 720 and the lower body member 730 are provided with respective guide posts 727, 737 slideably and telescopingly mounted in the guide bores 746A to permit the jaw portions 724 and 734 to be converged when the compression mechanism (not shown) is operated as discussed above.

Figure 23:
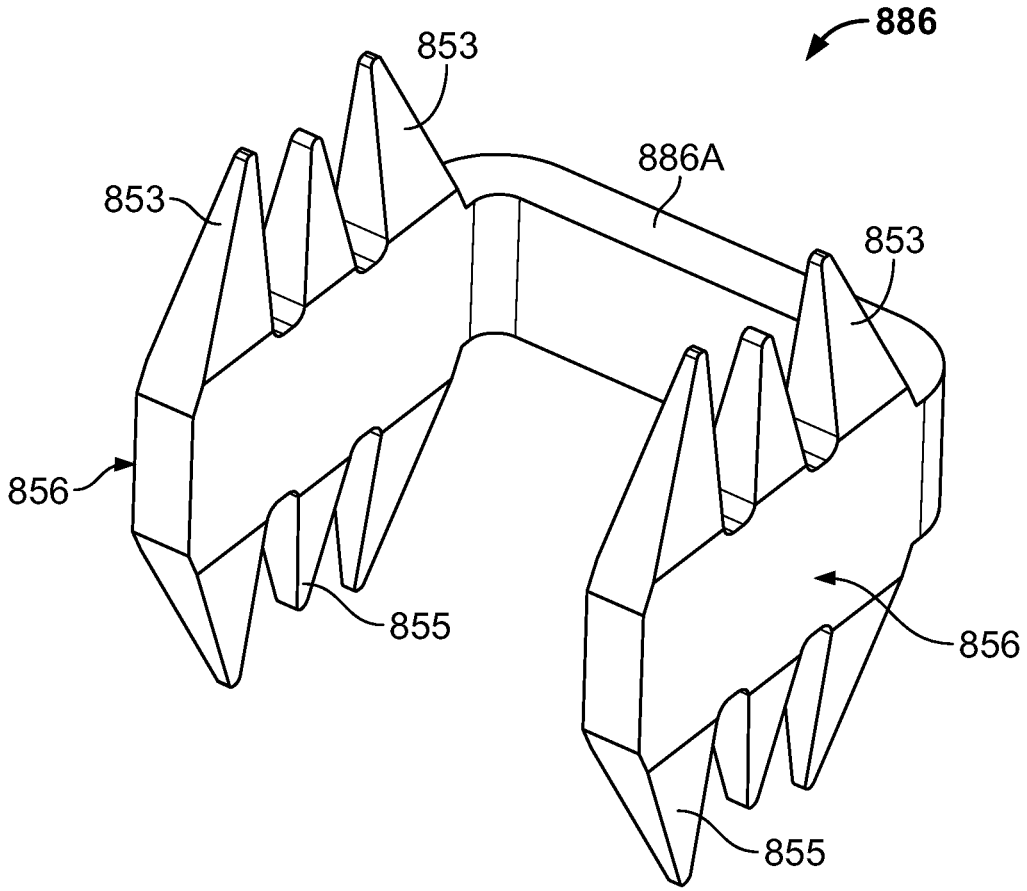
FIG. 23 is a perspective view of a blade member according to further embodiments of the present invention.

With reference to FIG. 23, an electrically conductive conductor blade member 886 according to further embodiments is shown therein. The blade member 886 may be used in place of the primary blade members pairs in any of the connectors described herein. For example, the blade member 886 may be used in place of the primary blade members 156. The blade member 886 may be formed of the materials discussed above with regard to the blade member 156 and, in some embodiments, is monolithic.

The blade member 886 includes a pair of spaced apart blade portions 856 mechanically and electrically connected by a bridge or connector portion 886A. As can be seen in FIG. 23, the blade portions 856 are configured in the same manner as the blade members 156, for example. It will be appreciated that the insulation piercing features 853, 855 will contact the cable conductors 12A, 14A in the same manner as the insulation piercing features 153, 155 to conduct current through the blade portions 856 between the cables. The connecting portion 886A provides additional current paths between the conductors 12A, 14A, which may increase current capacity.

According to further embodiments, the blade member 886 may be used in place of one or more of the supplemental blade members as disclosed herein (e.g., the blade member 152 and/or the blade member 154). For this purpose, the blade member 886 may be modified to eliminate the insulation piercing features 853.

Figure 24:
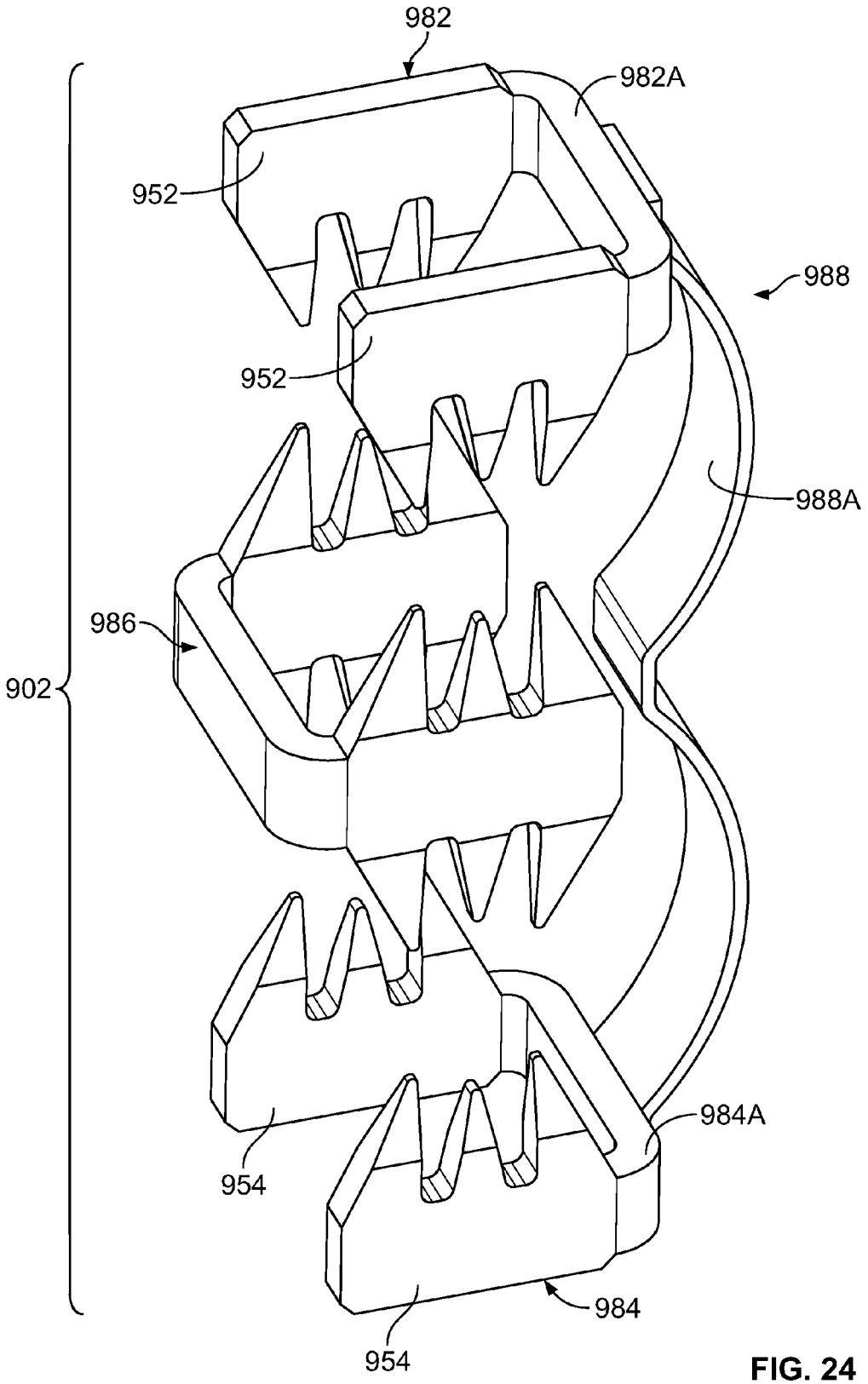
FIG. 24 is a perspective view of a connector contact set according to further embodiments of the present invention.

With reference to FIG. 24, a connector contact set 902 according to further embodiments is shown therein. The set 902 includes a conductive blade member 986 (corresponding to the blade member 886) and a blade member assembly 988. The assembly 988 includes an upper blade member 982 and a lower blade member 984 electrically connected by an electrically conductive, bendable or deformable connector portion 988A. The upper blade member 982 includes spaced apart blade portions 952 (corresponding to blade members 152) electrically and mechanically connected by a connector portion 982A. The lower blade member 984 includes spaced apart blade portions 954 (corresponding to the blade members 154) connected by a connector portion 984A. Thus, the blade member assembly 988 will serve as a second, outer primary conductor electrically connecting the cable conductors 12A, 14A.

The set 902 can be used in any of the connectors described herein in place of the contact sets described to provide improved current capacity. For example, the blade member 986 can replace the central primary blade members (e.g., blade members 156, 256, 356, 456, 556), and the blade member assembly 988 can replace the supplemental blade members (e.g., 152, 154, 252, 254, 352, 354, 452, 454, 552, 554).

Figure 25:
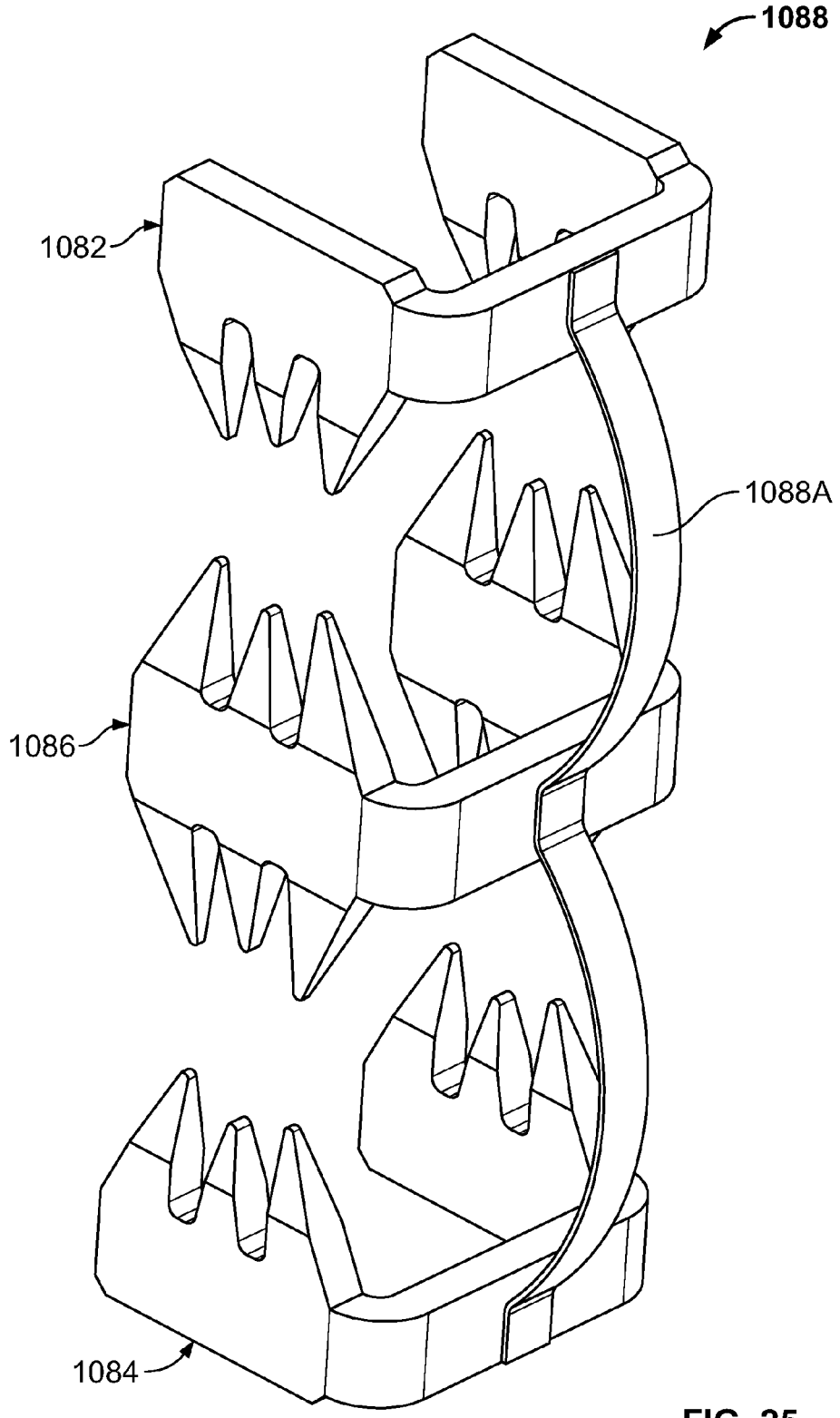
FIG. 25 is a perspective view of a blade member assembly according to further embodiments of the present invention.

With reference to FIG. 25, a blade member assembly 1088 according to further embodiments is shown therein. The assembly 1088 is constructed in the same manner as the set 902 except that the electrically conductive, bendable or deformable connector portion 1088A is electrically connected directly to the blade member 1086 as well as the blade members 1082 and 1084.

Figure 26:
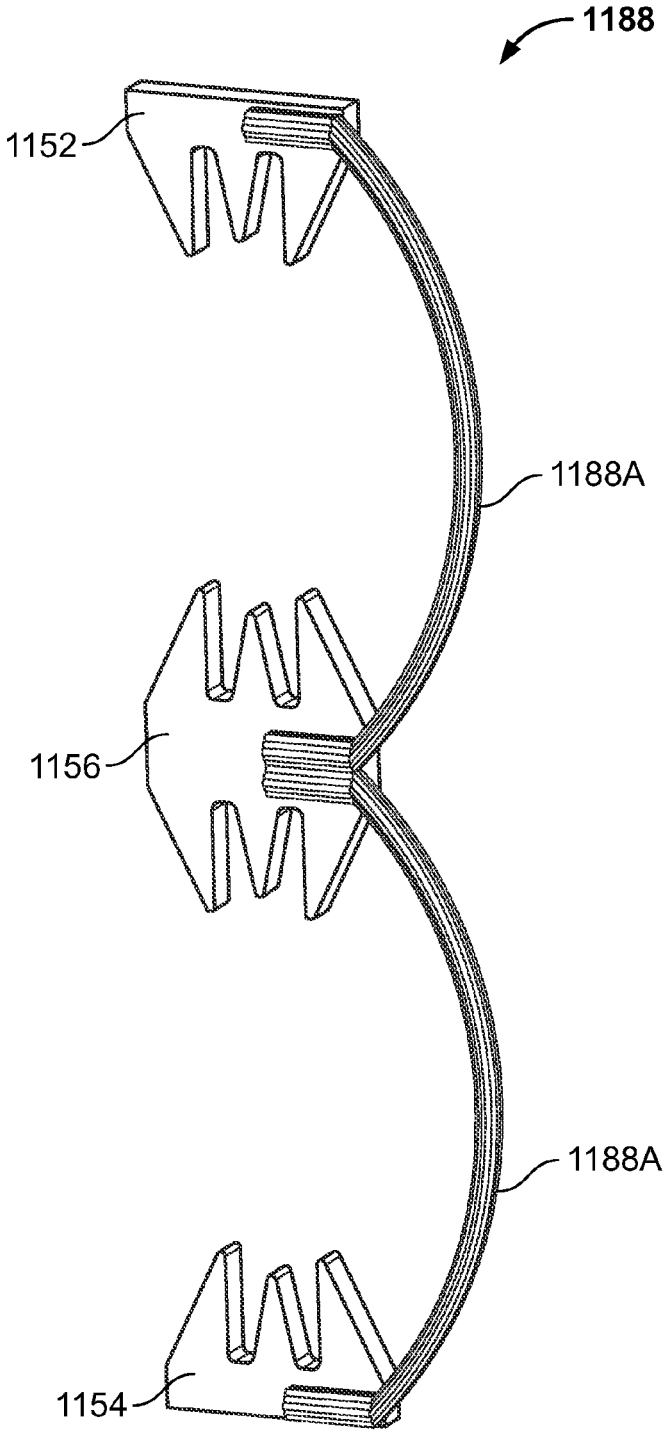
FIG. 26 is a perspective view of a blade member assembly according to further embodiments of the present invention.

FIG. 26 illustrates a blade member assembly 1188 according to further embodiments. The assembly 1188 includes an upper supplemental blade member 1152, a lower supplemental blade member 1154, and a primary blade member 1156 corresponding to the blade members 152, 154 and 156, respectively. The blade members 1152, 1154, 1156 are directly electrically connected by flexible, multi-strand, electrical conductors 1188A. According to some embodiments, the conductors 1188A are braided wires. The blade member assembly 1188 (or a side-by-side pair of assemblies 1188) may be used in any of the connectors disclosed herein in place of the disclosed blade members.

Figure 27:
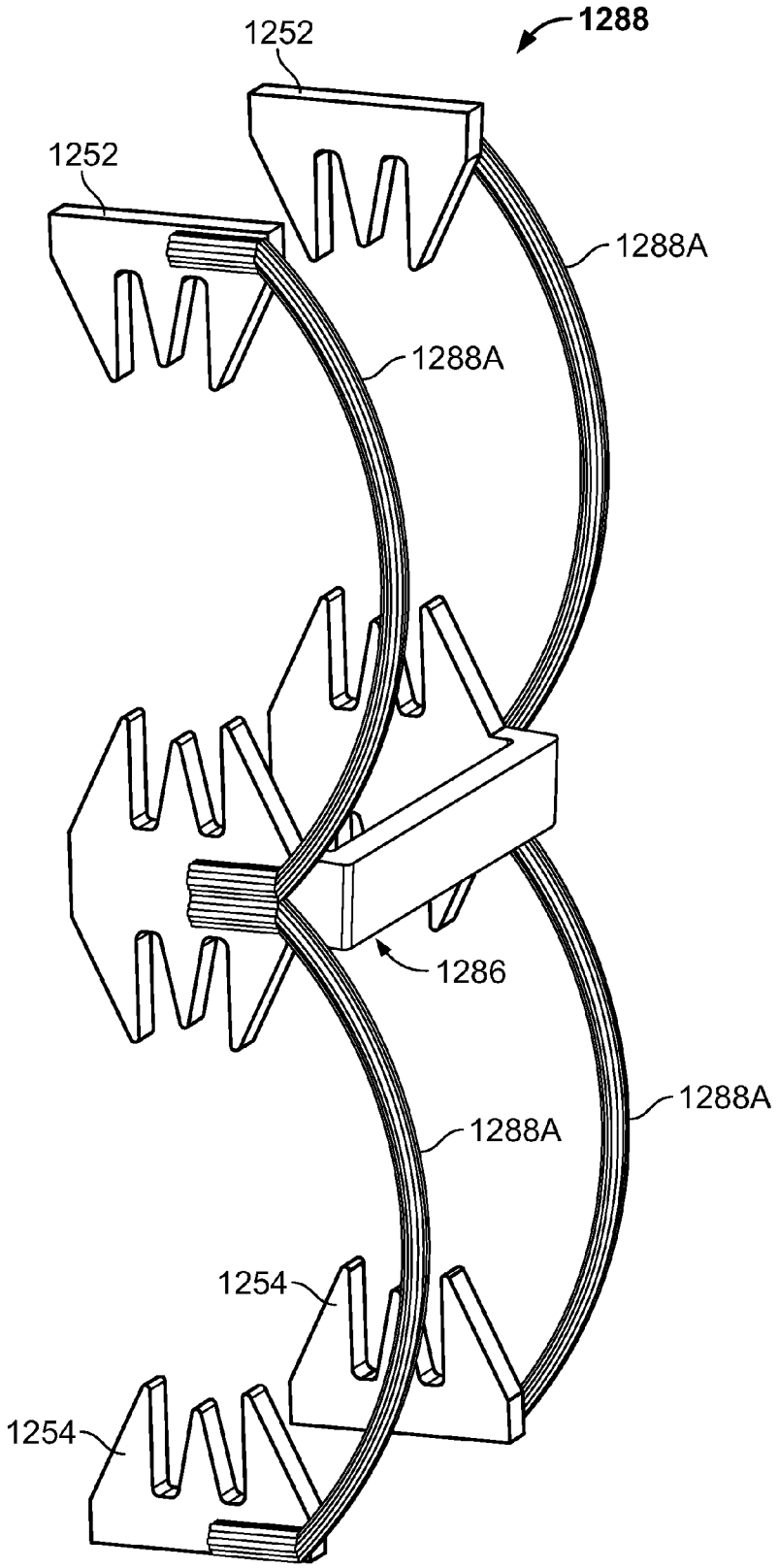
FIG. 27 is a perspective view of a blade member assembly according to further embodiments of the present invention.

FIG. 27 illustrates a blade member assembly 1288 according to further embodiments. The assembly 1288 includes a blade member 1286 corresponding to the blade member 886, and supplemental blade members 1252 and 1254 corresponding to the blade members 152 and 154, for example. The blade members 1252, 1254, 1256 are directly electrically connected by flexible, multi-strand electrical conductors 1288A corresponding to the conductors 1188A. The assembly 1288 may likewise be used in place of the other blade member sets described herein. The blade members 1252 and 1254 may be replaced with the blade members 982 and 984.

Figure 28:
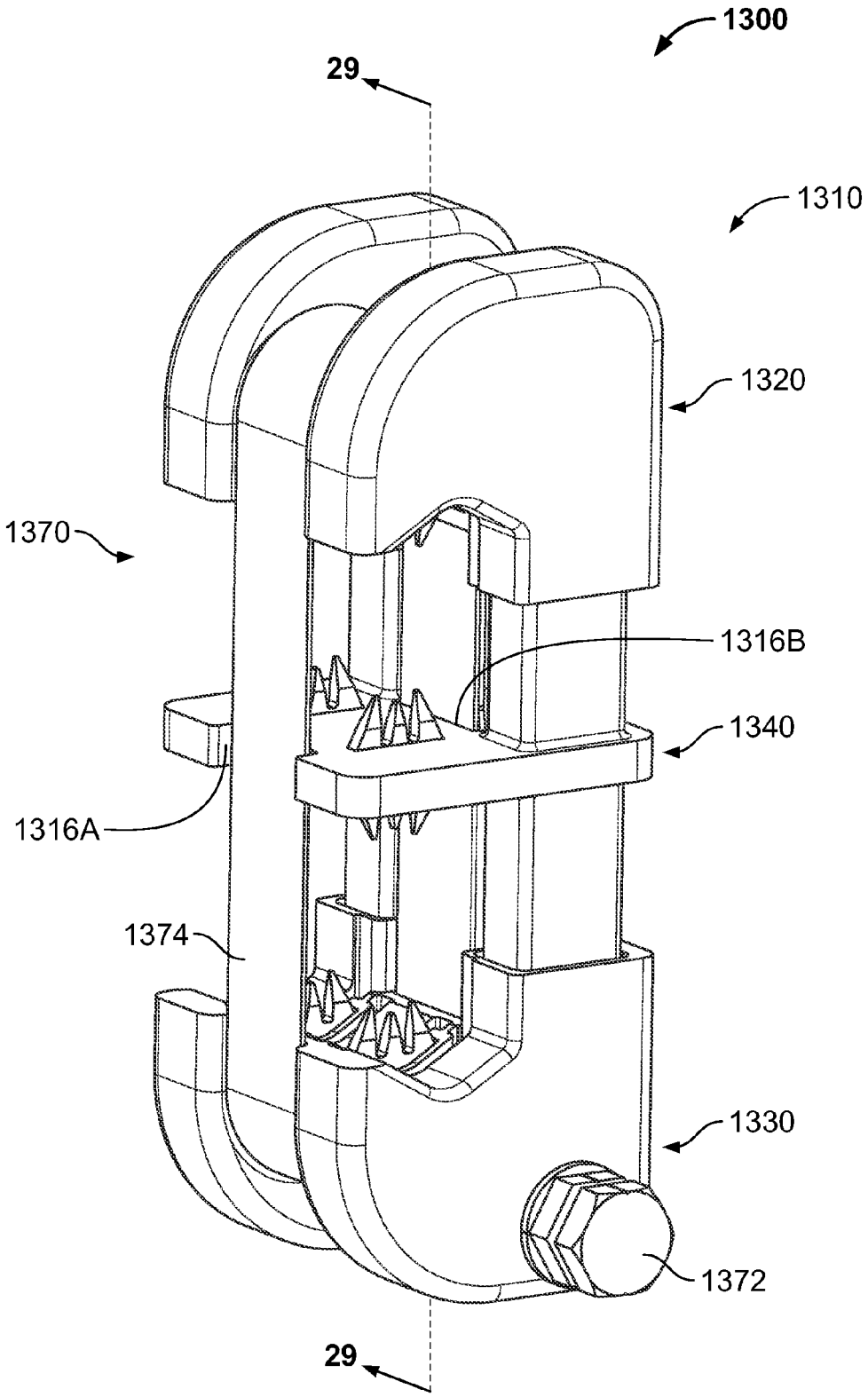
FIG. 28 is a perspective view of a connector according to further embodiments of the present invention in an open position.
Figure 29:
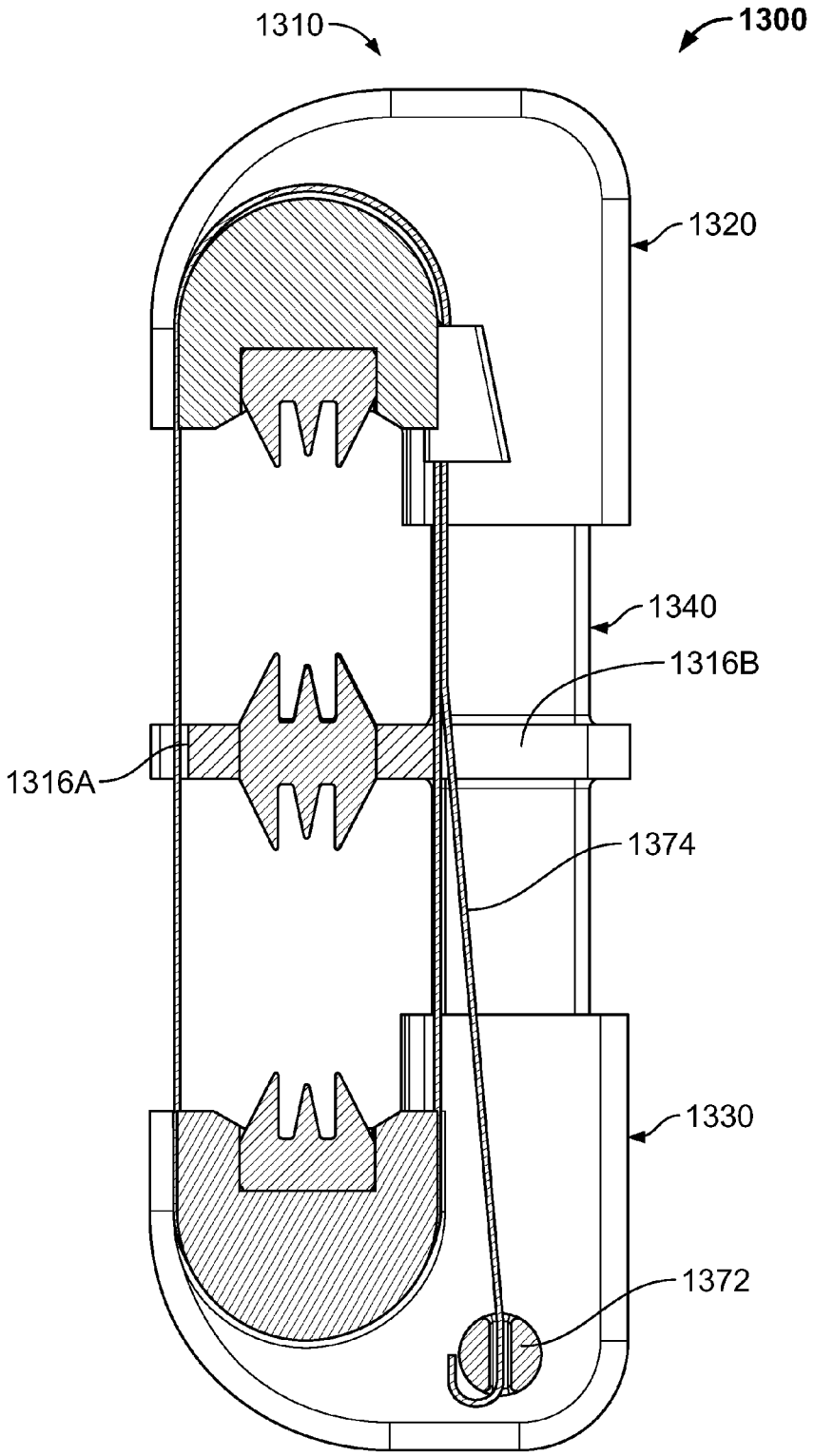
FIG. 29 is a cross-sectional view of the connector of FIG. 28 taken along the line 29-29 of FIG. 28.

With reference to FIGS. 28 and 29, a multi-tap or multi-cable insulation piercing electrical connector 1300 according to further embodiments of the present invention is shown therein. The connector 1300 is constructed and can be used in generally the same manner as the connector 600 except that the connector body assembly 1310 of the connector 1300 is configured differently than the connector body assembly 610. More particularly, the connector body assembly 1310 is configured and operable in substantially the same manner as the connector body assembly 710 (FIG. 22) and includes an upper body member 1320, a lower body member 1330, and an intermediate body member 1340. The connector body assembly 1310 differs from the connector body assembly 710 in that the shear bolt 1372 of the compression mechanism 1370 is rotatably mounted in the lower body member 1330. The intermediate body member 1340 is provided with strap guide grooves 1316A, 1316B (FIG. 28) to positively locate the compression strap 1374.

While the blade members (e.g., blade members 152, 154, 156) as shown herein are provided in pairs, each member set may include more or fewer blade members.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An electrical connector for mechanically and electrically connecting first and second cables, the first cable including an elongate first electrical conductor covered by a first insulation layer, the second cable including an elongate second electrical conductor covered by a second insulation layer, the electrical connector comprising:

a connector body including first, second and third body members including axially spaced apart first, second and third jaw portions, respectively, wherein:

a first cable slot is defined between the first and third jaw portions to receive the first cable;

a second cable slot is defined between the second and third jaw portions to receive the second cable; and the first and second body members are telescopingly arranged to permit the first and second body members to slide relative to one another along a slide axis;

an electrically conductive first insulation piercing feature on the connector body, wherein the first insulation piercing feature is configured to pierce through the first insulation layer and electrically engage the first electrical conductor;

an electrically conductive second insulation piercing feature on the connector body and electrically connected to the first insulation piercing feature, wherein the second insulation piercing feature is configured to pierce through the second insulation layer and electrically engage the second electrical conductor; and a compression mechanism configured and operable to apply a clamping load along a clamping axis extending through both of the first and second electrical conductors to force the first insulation piercing feature into electrical engagement with the first electrical conductor and to force the second insulation piercing feature into electrical engagement with the second electrical conductor to thereby provide electrical continuity between the first and second electrical conductors;

wherein the first, second and third jaw portions are relatively slidable along the slide axis substantially parallel with the clamping axis to independently adjust the sizes of the first and second cable slots when the compression mechanism is operated to apply the clamping load along the clamping axis.

2. The electrical connector of claim 1 wherein the electrical connector is configured to hold cables on only one side of the slide axis.

3. The electrical connector of claim 2 wherein the first and second cable slots are the only cable slots of the electrical connector.

4. The electrical connector of claim 1 wherein:

the first body member includes a rail portion;

the second body member includes a bore; and the first and second body members are telescopingly arranged with the rail portion slidably received in the bore to permit the first and second body members to slide relative to one another along a slide axis.

5. The electrical connector of claim 4 wherein the first and second body members are relatively configured to limit relative rotation therebetween.

6. The electrical connector of claim 1 including a third insulation piercing feature, wherein the third insulation piercing feature is located and configured to pierce through the first insulation layer and engage the first electrical conductor on a side opposite the first insulation piercing feature when the compression mechanism is operated to apply the clamping load along the clamping axis.

7. The electrical connector of claim 6 wherein the third insulation piercing feature includes at least one blade.

8. The electrical connector of claim 6 including a resilient sealing member surrounding at least a portion of the third insulation piercing feature and configured to engage the first insulation layer to environmentally seal an opening formed therein by the third insulation piercing feature.

9. The electrical connector of claim 1 including a primary blade member including an electrically conductive connecting portion and the first and second insulation piercing features.

10. The electrical connector of claim 9 wherein the first and second insulation piercing features are located on opposed ends of the connecting portion and the clamping axis extends through the connecting portion and the first and second insulation piercing features.

11. The electrical connector of claim 10 wherein the primary blade member is monolithic.

12. The electrical connector of claim 10 wherein the distance between the first and second insulation piercing features is less than about 30 mm.

13. The electrical connector of claim 10 wherein each of the first and second insulation piercing features includes a plurality of teeth.

14. The electrical connector of claim 10 wherein:

the third body member is positionable between the first and second electrical conductors; and the primary blade member extends fully through the third body member.

15. The electrical connector of claim 10 including an electrically conductive third insulation piercing feature on the connector body, wherein the third insulation piercing feature is located and configured to pierce through the first insulation layer and electrically engage the first electrical conductor on a side opposite the first insulation piercing feature when the compression mechanism is operated to apply the clamping load along the clamping axis.

16. The electrical connector of claim 15 including:

an electrically conductive fourth insulation piercing feature on the connector body, wherein the fourth insulation piercing feature is located and configured to pierce through the second insulation layer and electrically engage the second electrical conductor on a side opposite the second insulation piercing feature when the compression mechanism is operated to apply the clamping load along the clamping axis; and a electrically conductive second connecting portion extending between and electrically connecting the third and fourth insulation piercing features.

17. The electrical connector of claim 16 wherein the second connecting portion is flexible.

18. The electrical connector of claim 10 wherein the first and second insulation piercing features and the first connecting portion form a first blade portion of the primary blade member, and the primary blade member further includes:

a second blade portion spaced apart from the first blade portion, the second blade portion including a second electrically conductive connection portion and third and fourth insulation piercing features located on opposed ends of the second connecting portion; and an electrically conductive bridge portion mechanically and electrically connecting the first and second blade portions.

19. The electrical connector of claim 1 wherein the compression mechanism includes cooperating threaded members configured to force the first and second jaw portions toward one another when relatively rotated.

20. The electrical connector of claim 1 wherein the compression mechanism includes a flexible compression strap and a tensioning mechanism operable to apply a tension load to the flexible compression strap to force the first and second jaw portions toward one another.

21. The electrical connector of claim 20 wherein the compression mechanism includes a locking mechanism to retain a tension load in the flexible compression strap.

22. The electrical connector of claim 20 wherein the tensioning mechanism includes a take up member rotatable to wind a portion of the flexible compression strap thereon to thereby apply the tension load to the flexible compression strap.

23. The electrical connector of claim 1 wherein the compression mechanism includes a shear head to limit the clamping load applied to the first and second cables by the electrical connector.

24. The electrical connector of claim 1 including an electrically conductive third insulation piercing feature on the connector body, wherein:

the third insulation piercing feature is located and configured to pierce through the first insulation layer and electrically engage the first electrical conductor on a side opposite the first insulation piercing feature to provide a low resistance current path between strands of the first electrical conductor; and the electrical connector is configured such that, when the electrical connector is installed on the first and second cables, the third insulation piercing feature is substantially only electrically connected to the second electrical conductor through the first electrical conductor.

25. The electrical connector of claim 24 including an electrically conductive fourth insulation piercing feature on the connector body, wherein the fourth insulation piercing feature is located and configured to pierce through the second insulation layer and electrically engage the second electrical conductor on a side opposite the second insulation piercing feature to provide a low resistance current flow path between strands of the second electrical conductor;

wherein the electrical connector is configured such that, when the electrical connector is installed on the first and second cables, the fourth insulation piercing feature is substantially only electrically connected to the first electrical conductor through the second electrical conductor.

26. A method for mechanically and electrically connecting first and second cables, the first cable including an elongate first electrical conductor covered by a first insulation layer, the second cable including an elongate second electrical conductor covered by a second insulation layer, the method comprising:

providing an electrical connector comprising:

a connector body including first, second and third body members including axially spaced apart first, second and third jaw portions, respectively, wherein:

a first cable slot is defined between the first and third jaw portions to receive the first cable;

a second cable slot is defined between the second and third jaw portions to receive the second cable; and the first and second body members are telescopingly arranged to permit the first and second body members to slide relative to one another along a slide axis;

an electrically conductive first insulation piercing feature on the connector body, wherein the first insulation piercing feature is configured to pierce through the first insulation layer and electrically engage the first electrical conductor;

an electrically conductive second insulation piercing feature on the connector body and electrically connected to the first insulation piercing feature, wherein the second insulation piercing feature is configured to pierce through the second insulation layer and electrically engage the second electrical conductor; and a compression mechanism configured and operable to apply a clamping load along a clamping axis; and placing the first and second cables in the electrical connector such that the first and second electrical conductors are aligned along the clamping axis; and operating the compression mechanism to apply the clamping load along the clamping axis extending through both of the first and second electrical conductors to force the first insulation piercing feature into electrical engagement with the first electrical conductor and to force the second insulation piercing feature into electrical engagement with the second electrical conductor to thereby provide electrical continuity between the first and second electrical conductors;

wherein the first, second and third jaw portions are relatively slidable along the slide axis substantially parallel with the clamping axis to independently adjust the sizes of the first and second cable slots when the compression mechanism is operated to apply the clamping load along the clamping axis.

* * * * *